US011319785B1

(12) United States Patent
Green

(10) Patent No.: US 11,319,785 B1
(45) Date of Patent: May 3, 2022

(54) DOWNHOLE TOOL MOVEMENT CONTROL SYSTEM AND METHOD OF USE

(71) Applicant: Well Master Corporation, Golden, CO (US)

(72) Inventor: David A. Green, Highlands Ranch, CO (US)

(73) Assignee: Well Master Corporation, Golden, CO (US)

( * ) Notice: Subject to any disclaimer, the term of this patent is extended or adjusted under 35 U.S.C. 154(b) by 0 days.

(21) Appl. No.: 17/576,841

(22) Filed: Jan. 14, 2022

Related U.S. Application Data

(60) Provisional application No. 63/138,496, filed on Jan. 17, 2021.

(51) Int. Cl.
*E21B 43/12* (2006.01)

(52) U.S. Cl.
CPC ..... *E21B 43/121* (2013.01); *E21B 43/12* (2013.01)

(58) Field of Classification Search
CPC ..... E21B 43/12; E21B 43/121; E21B 34/16; E21B 34/06
See application file for complete search history.

(56) References Cited

U.S. PATENT DOCUMENTS

| | | | | |
|---|---|---|---|---|
| 5,146,991 | A | 9/1992 | Rodgers | |
| 5,878,817 | A * | 3/1999 | Stastka | E21B 43/121 166/372 |
| 7,395,865 | B2 | 7/2008 | Bender | |
| 7,793,728 | B2 | 9/2010 | Bender | |
| 8,464,798 | B2 | 6/2013 | Nadkrynechny | |
| 8,627,892 | B2 | 1/2014 | Nadkrynechny | |
| 8,863,837 | B2 | 10/2014 | Bender | |
| 8,869,902 | B2 | 10/2014 | Smith | |
| 2006/0054329 | A1 * | 3/2006 | Chisholm | E21B 47/01 166/372 |
| 2012/0193091 | A1 * | 8/2012 | Bender | F04B 47/12 166/250.15 |
| 2015/0136389 | A1 * | 5/2015 | Bergman | E21B 43/121 166/250.15 |
| 2018/0119692 | A1 * | 5/2018 | Bangor | F04B 47/02 |
| 2020/0248521 | A1 | 8/2020 | Southard | |

* cited by examiner

*Primary Examiner* — Brad Harcourt
(74) *Attorney, Agent, or Firm* — Critical Path IP Law, LLC

(57) ABSTRACT

A downhole tool movement control system and method of use, such as a movement control system to control the speed of a plunger tool when operating within a tubing string of a wellbore, such as when rising within a tubing string of a wellbore. In one embodiment, the downhole tool movement control system includes a system controller operating to control a system valve to regulate the plunger tool speed, the system controller settings based on a set of system parameters.

20 Claims, 11 Drawing Sheets

| $P_{LINE}$ | 1,000 PSI | 150 PSI | 25 PSI | 150 PSI | 25 PSI |
|---|---|---|---|---|---|
| $P_{BH}$ | 1,500 PSI | 1,500 PSI | 1,500 PSI | 750 PSI | 300 PSI |
| Ratio $P_{LINE}$ : $P_{BH}$ | 1.5:1 | 10:1 | 60:1 | 5:1 | 12:1 |
| **Plunger speed at surface[1]** | 450 FPM[2] | 3,000 FPM | 18,000 FPM | 1,500 FPM | 3,600 FPM |
| **Plunger average speed[3]** | 375 FPM | 1,650 FPM | 9,125 FPM | 900 FPM | 1,950 FPM |

[1] Assumes plunger break-out speed of 300 FPM at well bottom

[2] Plunger speed at surface is 300 FPM x ratio = 300 FPM x 1.5 = 450 FPM

[3] Average speed is (plunger speed at surface + break-out speed of 300 FPM) / 2

Fig. 6

DOWNHOLE TOOL MOVEMENT CONTROL SYSTEM AND METHOD OF USE

CROSS-REFERENCE TO RELATED APPLICATION

This application is a nonprovisional patent application of and claims the benefit of U.S. Provisional Patent Application No. 63/138,496 titled "Downhole Tool Movement Control System and Method of Use" and filed Jan. 17, 2021, the disclosure of which is hereby incorporated herein by reference in entirety.

FIELD

The present invention is directed to a downhole tool movement control system and method of use, such as a movement control system to control the ascent (or fall) speed of a plunger tool when rising (or falling) within a production line of a wellbore.

BACKGROUND

Downhole tools commonly used in oil and gas wells operate within production lines of a wellbore. Some downhole tools, such as plungers, typically operate the entire length of the production line, from wellhead to bottom hole. The phrase "downhole tool" means any device inserted into a production line that freely move within a production line without a physical attachment such as a wire, cable rope, rod, etc. Since these downhole tools are designed to be free-cycling, that is, not connected to any physical guiding or driving mechanism, they are subject to pressure and fluid flow conditions in the production line of the well which may vary greatly over the depth of the well and from one well to another. (Note: Plungers may operate in tubing strings of a well, which are the most common, but plungers may also operate in casing strings of a well; the phrase "production line" means any production conduit of a well, to include tubing strings and casing strings).

During ascent, the plunger typically operates as a liquid pump to bring fluid (aka "plunger lift") to the wellhead to increase operating performance of the well. The term "fluid" means a substance devoid of shape and yields to external pressure, to include liquids and gases, e.g., water and hydrocarbons in liquid or gaseous form, and combinations of liquids and gases.

A plunger is often arranged to travel upward within a preferred average speed range, if not at a preferred speed value, to most effectively bring fluid to the wellhead. Typically, plungers are operated in a widely varying speed range due to, for example, a lack of plunger location data within the tubing string and a lack of control mechanism to slow or accelerate the plunger. At best, the plunger may be operated to achieve an average speed during ascent, an average which frequently includes operating tranches of ineffectively high or low speed that do not support efficiency of the intended fluid lift. A plunger operating at too slow a speed allows gas to slip past the plunger and can result in a plunger stalling before reaching the wellhead. In some situations, the plunger may contact the wellhead at dangerously high speeds, resulting in plunger damage, surface lubricator damage, wellhead damage and, on occasion, breach of the wellhead. Examples of plunger speeds under various well conditions is provided with respect to FIG. 6.

(Note that the terms "speed" and "velocity" are used interchangeably in the disclosure, e.g., such as in the phrases "plunger speed" and "plunger velocity" and "fluid speed" and "fluid velocity," to mean the rate of movement in a defined space, e.g., plunger speed means the rate of movement of a plunger within a production line).

What is needed is a system and method to control the ascent (or descent, aka fall) speed of a plunger tool when rising (or falling) within a production line of a wellbore and, in some embodiments, to control the stop location of a plunger at a selected downhole position within a production line.

SUMMARY

A downhole tool movement control system to control the ascent (or fall) speed of a plunger tool when rising (or falling) within a production line of a wellbore is disclosed. The benefits of such a system and method of use include increased fluid lift efficiency, increased well productivity, increased plunger life, and increased safety.

The system and method are applicable to any free-traveling downhole tool used in a production line and is specifically not limited to plungers. For example, the system and method of use may be used to control the movement of any downhole tool placed within a production line during any phase of a wellbore, to include during well drilling, well formation and evaluation, well intervention, well servicing, well data collection and/or datalogging, well completion and oil and gas production.

The disclosure provides several embodiments of downhole tool movement control systems and method of use.

In one embodiment, a downhole tool movement control system is disclosed, the system comprising: a system controller comprising a system processor, the system controller operating to control a downhole tool velocity of a downhole tool within a selectable steady state velocity range, the downhole tool operating within a tubing string disposed within a well casing and having a first tubing string portion and a second tubing string portion and configured to receive the downhole tool, the tubing string in fluid communication with a hydrocarbon deposit and having a set of well parameters comprising a first set of well parameters, the downhole tool having a set of downhole tool parameters; and a system control valve in fluid communication with the tubing string and having a set of system control valve settings comprising an initial system control valve setting, the system control valve controlled by the system controller; wherein: based on the first set of well parameters, the set of downhole tool parameters, and the initial system control valve setting, the system processor calculates: a) the downhole tool velocity at a set of downhole tool locations, and b) a corresponding first set of controller system control valve settings at each of the downhole tool locations that will operate the downhole tool within the selectable steady state velocity range; the system controller operates the system control valve at the set of controller system control valve settings corresponding to the set of downhole tool locations as the downhole tool travels to each of the set of downhole tool locations; the velocity of the downhole tool at each of the set of downhole tool locations is within the selectable steady state velocity range; and the system control valve settings comprise a system control valve flow rate setting.

In one feature, the tubing string comprises a set of tubing string sections to form a tubing string of tubing string total length, each of the tubing string sections comprising at least one of the set of downhole tool locations. In another feature, the downhole tool travels a cycle, the cycle defined as travel from the first tubing string portion to the second tubing string portion and back to the first tubing string portion, the cycle having a first measured cycle time, the first measured cycle time measured by a sensor positioned at the wellhead portion; the processor calculates a first predicted cycle time of the cycle and calculates a first cycle time differential defined as the difference between the first measured cycle time and the first predicted cycle time; and the processor calculates a second set of controller system control value settings associated with the first cycle time differential. In another feature, the first tubing string portion is coupled to a wellhead portion of tubing string and the second tubing string portion is coupled to a bottom hole assembly. In another feature, the set of downhole tool parameters include a downhole tool notional rise velocity profile and a downhole tool notional fall velocity profile, and the downhole tool is a plunger. In another feature, the system processor calculates the downhole tool velocity at the set of downhole tool locations at least at a 1 Hz rate. In another feature, the downhole tool has a selectable maximum velocity; and the downhole tool velocity never exceeds the selectable maximum velocity. In another feature, the downhole tool has a selectable average steady state velocity and an average of the downhole tool steady state velocity is within 20% of the selectable average steady state velocity.

In another embodiment, a downhole tool movement control system is disclosed, the system comprising: a system controller comprising a system processor, the system controller operating to control a downhole tool velocity of a downhole tool at a selectable velocity schedule, the downhole tool operating within a tubing string disposed within a well casing and having a first tubing string portion and a second tubing string portion and configured to receive the downhole tool, the tubing string in fluid communication with a hydrocarbon deposit and having a set of well parameters comprising a first set of well parameters, the downhole tool having a set of downhole tool parameters, the selectable velocity schedule defining a set of downhole tool velocities at a set of tubing string locations; and a system control valve in fluid communication with the tubing string and having a set of system control valve settings comprising an initial system control valve setting, the system control valve controlled by the system controller, the set of system control valve settings determining a set of control valve flow rates; wherein: based on the first set of well parameters, the set of downhole tool parameters, and the initial system control valve setting, the system processor calculates: a) a set of downhole tool velocities at the set of tubing locations, and b) a corresponding first set of controller system control valve settings at each of the tubing string locations that will operate the downhole tool at the selectable velocity schedule; the system controller operates the system control valve at the set of controller system control valve settings corresponding to the set of tubing string locations as the downhole tool travels to each of the set of tubing string locations; and the set of velocities of the downhole tool at each of the set of tubing string locations is within a selectable velocity range.

In one feature, the first tubing string portion is coupled to a wellhead portion of tubing string and the second tubing string portion is coupled to a bottom hole assembly; the set of wellhead parameters comprise a tubing inner diameter, a tubing pressure, a line pressure, a gas rate, a liquid/gas ratio, gas and liquid properties and a depth to the bottom hole assembly; and the set of downhole tool properties comprise downhole tool type, downhole tool notional fall velocity profile and/or characteristics, and downhole tool notional rise velocity profile and/or characteristics. In another feature, the system processor further calculates a set of fluid velocities within the tubing string at each of the set of tubing string locations, the calculation of the set of downhole tool velocities associated with the set of gas fluid velocities.

In yet another embodiment, a method of controlling velocity of a downhole tool within a tubing string of a well casing, the method comprising: positioning a downhole tool within a tubing string, the tubing string disposed within a well casing and having at least a first tubing string portion and a second tubing string portion, the downhole tool configured to travel within the tubing string between a first tubing string portion and a second tubing string portion, the travel at a selectable velocity range, the tubing string in fluid communication with a hydrocarbon deposit and having a set of well parameters comprising a first set of well parameters; providing a system control valve in fluid communication with the tubing string and having a set of system control valve settings comprising an initial system control valve setting, the set of system control valve settings associated with a set of system control valve flow rate settings; providing a system controller comprising a computer processor, the computer processor having machine-executable instructions operating to: receive the first set of well parameters; receive the initial system control valve setting; receive a set of downhole tool parameters comprising a downhole tool type; calculate the downhole tool velocity at a set of downhole tool locations within the tubing string based on the first set of well parameters, the set of downhole tool parameters, and the initial system control valve setting; calculate a first set of controller system control valve settings corresponding to each of the set of downhole tool locations, the first set of controller system control valve settings calculated so that the downhole tool operates within the selectable steady state velocity range at each of the set of downhole tool locations; communicate the set of controller system valve settings to the system control valve; and operate the system control valve to the first set of controller system valve settings corresponding to the set of downhole tool locations as the downhole tool travels to each of the set of downhole tool locations; wherein: the velocity of the downhole tool at each of the set of downhole tool locations is within the selectable steady state velocity range.

In one feature, the tubing string comprises a set of tubing string sections of uniform length to form a tubing string of tubing string total length, each of the tubing string sections comprising at least one of the set of downhole tool locations. In another feature, the first tubing string portion is coupled to a wellhead portion of tubing string and the second tubing string portion is coupled to a bottom hole assembly. In another feature, the downhole tool travels a cycle, the cycle defined as travel from the first tubing string portion to the second tubing string portion and back to the first tubing string portion, the cycle having a first measured cycle time, the first measured cycle time measured by a sensor positioned at the wellhead portion; the processor calculates a first predicted cycle time of the cycle and calculates a first cycle time differential defined as the difference between the first measured cycle time and the first predicted cycle time; and the processor calculates a second set of controller system control value settings associated with the first cycle time differential. In another feature, the set of downhole tool parameters include a downhole tool notional rise velocity profile and a downhole tool notional fall velocity profile, and the downhole tool is a plunger. In another feature, the set of well parameters include at least one of pressure in the first tubing portion, pressure in the second tubing portion, and bottom hole pressure. In another feature, the method further comprises the step of selecting a downhole tool tubing string stop point located between the first tubing string portion and the second tubing string portion, the system controller operating to stop the travel of the downhole tool substantially near the downhole tool stop point. In another feature, the set of well parameters comprise a set of measured well parameters to include gas rate and at least one of tubing pressure and line pressure; and the measured well parameters are output by a flow measurement unit in fluid communication with the tubing string. In another feature, the set of well parameters comprise a set of calculated well parameters to include a set of gas velocities at each of the set of downhole tool locations.

For a more detailed description of plungers see, e.g., U.S. Pat. Nos. 7,395,865 and 7,793,728 to Bender; U.S. Pat. No. 8,869,902 to Smith et al; and U.S. Pat. Nos. 8,464,798 and 8,627,892 to Nadkrynechny, each of which are incorporated by reference in entirety for all purposes. For a more detailed description of wellbore operations see, e.g., Bender U.S. Pat. No. 8,863,837, incorporated by reference in entirety for all purposes.

An "interior flow-through plunger" means any plunger in which fluid passes through at least some of an interior cavity of a plunger and including, for example, the set of plungers described in U.S. patent application Ser. No. 16/779,448 to Southard et al, and plungers that are commonly termed "bypass plungers." U.S. patent application Ser. No. 16/779,448 is incorporated by reference in entirety for all purposes. Note that any embodiment and/or element of the disclosure that engages with, interconnects to, or otherwise references a "bypass plunger" or a "plunger" may also more broadly engage with, interconnect to, or reference an interior flow-through plunger or other downhole tool.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The disclosure will be readily understood by the following detailed description in conjunction with the accompanying drawings, wherein like reference numerals designate like elements. The elements of the drawings are not necessarily to scale relative to each other. Identical reference numerals have been used, where possible, to designate identical features that are common to the figures.

FIG. 6 provides data tables of calculations for various plunger operations.

It should be understood that the proportions and dimensions (either relative or absolute) of the various features and elements (and collections and groupings thereof) and the boundaries, separations, and positional relationships presented there between, are provided in the accompanying figures merely to facilitate an understanding of the various embodiments described herein and, accordingly, may not necessarily be presented or illustrated to scale (unless so stated on any particular drawing), and are not intended to indicate any preference or requirement for an illustrated embodiment to the exclusion of embodiments described with reference thereto.

DETAILED DESCRIPTION

Embodiments of a downhole tool movement control system and method of use are disclosed. The downhole tool movement control system may be referred to simply as "system" and the method of use of a downhole tool movement control system may be referred to simply as "method."

Generally, the downhole tool movement control system operates to control the movement of a downhole tool within a production line through control of at least one system valve. The system valve, controlled by way of a system controller, operates on the production line to control conditions within the production line, such as various pressures within the production line, to effect and control the movement, such as the speed/velocity, of the downhole tool. Note that the system valve refers to any flow regulating device, including variable-opening valves and automatic chokes amongst others. In one embodiment, more than one system valve is employed to control the movement, such as the speed, of the downhole tool. For example, a supplemental gas volume may be supplied to the annulus of a well wherein the gas enters the tubing string at the tubing string bottom or some other intermediate point, thereby increasing gas pressure at that position. The supplemental gas volume is controlled by one or more supplemental valves. This example is common in the field of Gas Lift and in common practices of Gas Lift or gas injection in combination with plunger lift, commonly known as Plunger Assisted Gas Lift and Gas Assisted Plunger Lift.

Figure 1A:
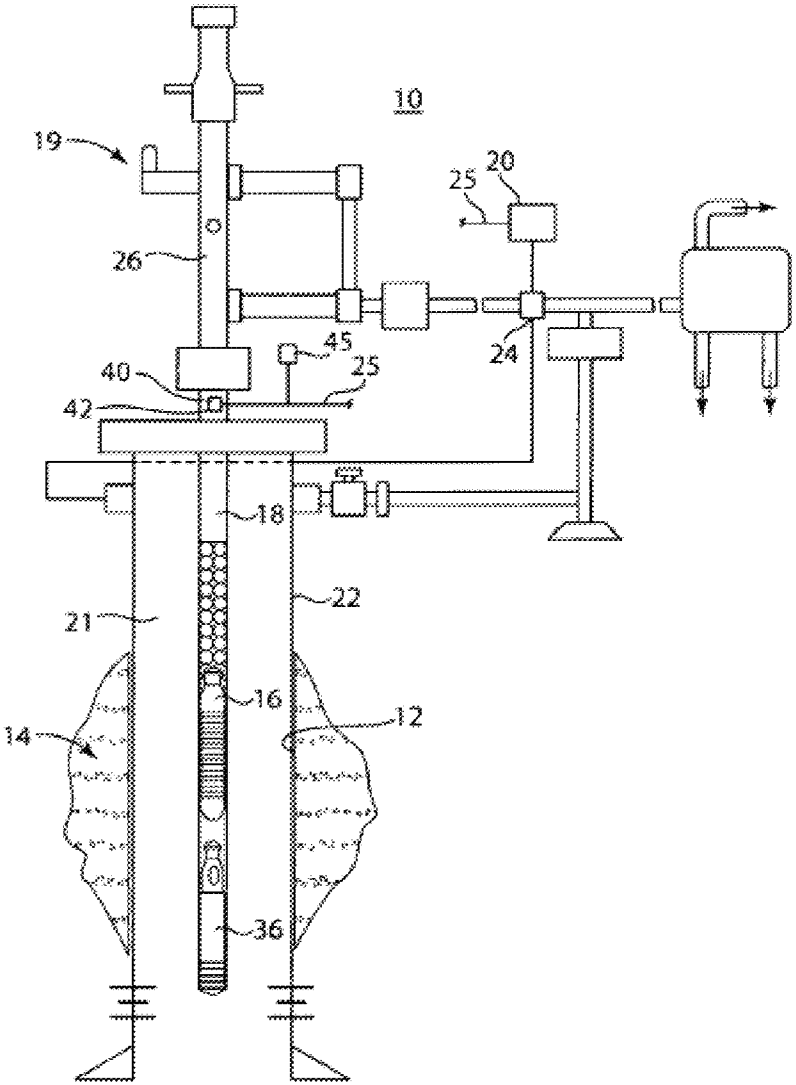
Fig. 1A (Prior Art)
FIG. 1A is a side view representation of a well production system of the prior art.

FIG. 1A is a side view representation of a well production system of the prior art. The figure is from U.S. Pat. No. 8,863,837 to Bender et al ("Bender"). The general components, and details of operation, of the well system 10 of FIG. 1 are provided in Bender and will not be extensively detailed here for brevity. Note the system valve 24, as controlled by controller 20, operating to control fluid conditions within tubing string 18 which influences plunger 16 kinematics. The term "kinematics" means a description of motion, such as the description of motion of a plunger in a tubing string, to specifically include plunger location and speed). Many of the general components of the well system 10 are similar to those of the downhole tool movement control system of the disclosure, with deliberately similar element numbers. For example, the annulus 21 of Bender's well 14 is similar to the annulus 221 and well 214 of the disclosed downhole tool movement control system 200 of FIG. 2.

Figure 1B:
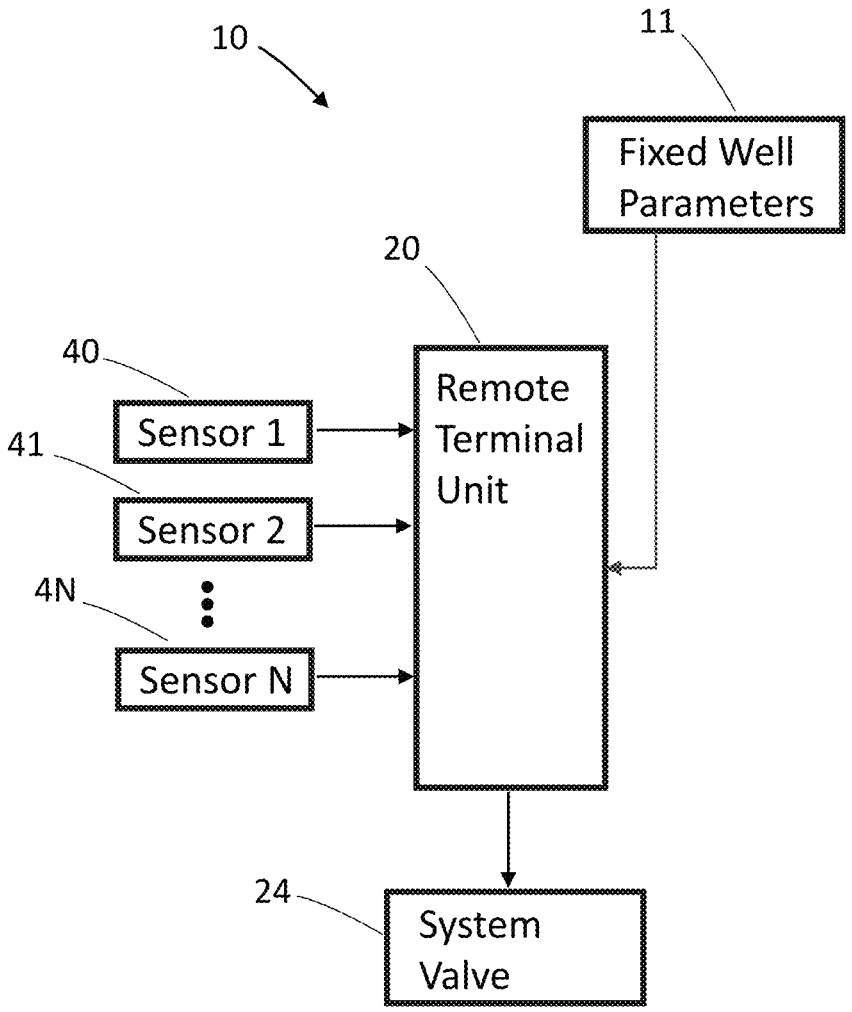
Fig. 1B (Prior Art)
FIG. 1B is a schematic block diagram of a well pressure control system of the prior art.

FIG. 1B is a schematic block diagram of a well pressure control system of the prior art, such as the well pressure control system of FIG. 1A. The computer controller 20, may be a standalone control device or one commonly termed a Remote Terminal Unit (RTU) by those skilled in the art, operates the system valve 24. The RTU (or control computer) typically receives a set of fixed well parameters and one or more sensor inputs 40, 41 through 4N to determine a setting for the system valve, such as a pressure setting in PSI. The sensor inputs may comprise a pressure value at the wellhead, depicted as sensor 40. The RTU (or control computer) may integrate with and/or interact with a Supervisory Control and Data Acquisition (SCADA) system, as known by those skilled in the art.

The fixed well parameters 11 may include one or more of tubing size (e.g., the inner diameter of the tubing), depth to the Bottom Hole Assembly (BHA), liquid/gas ratio(LGRs), gas and/or liquid properties (e.g., gas densities), plunger selection or plunger type (e.g., plunger geometries and/or notional or nominal plunger performance/kinematics), desired or targeted or selectable plunger velocity, and desired or targeted or selectable plunger maximum velocity.

A conventional well pressure control system 10 of the prior art, such as that depicted in FIG. 1B, does not actively control the speed of the plunger 18, but rather determines a static set point or set value for the system valve pressure value that is estimated to provide an average speed for the plunger equal to the desired or targeted plunger speed $v_{set}$. The plunger average speed or average velocity is $v_{ave}$. As briefly described above, such an average speed during ascent will typically include operating tranches of ineffectively high or low speed that do not support efficiency of the intended fluid lift. The actual plunger speed or velocity is $v_p$. Many controllers, control systems and RTU's have algorithms which make adjustments to timing or triggering of state changes (for example valve closed, valve open, flow after plunger arrival) which are intended to alter the arrival time of a rising plunger, effectively adjusting the average rise velocity. These algorithms however, fail to provide real-time control of the rise or fall speed of the plunger during those actual portions of the cycle. In contrast, the system of the disclosure, among other things, does provide real-time control of the rise or fall speed of the plunger during actual portions of the cycle. Also, some conventional systems manage or control an average plunger velocity, such as U.S. Pat. No. 5,146,991 to Rogers, incorporated by reference in entirety for all purposes. In contrast, the disclosed system controls the instant plunger velocity during the entirety of the plunger cycle.

Various embodiments of a downhole tool movement control system and method of use will now be described with respect to FIGS. 2A, 2B, 3, and 4.

Figure 2A:
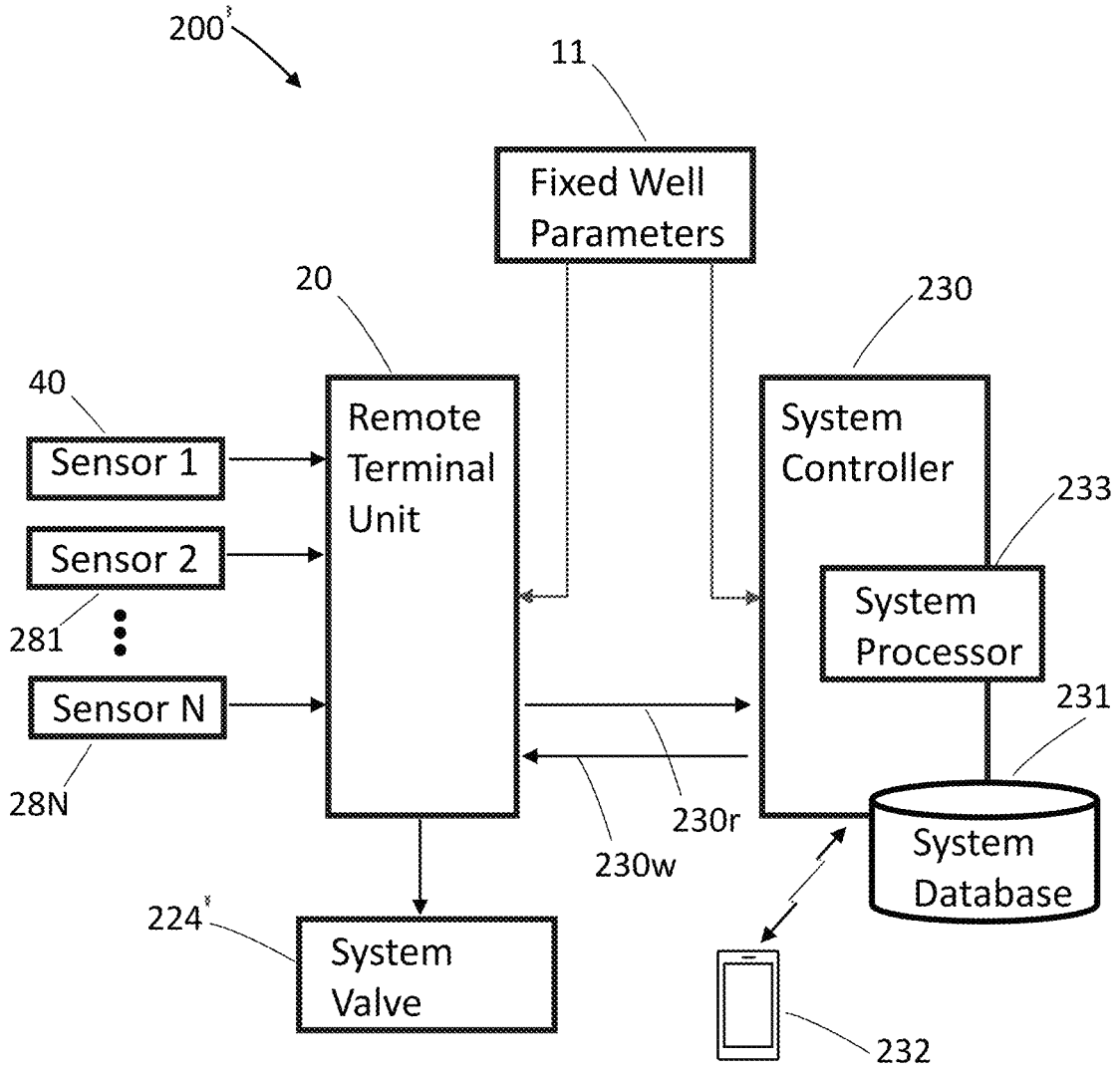
FIG. 2A is a schematic block diagram of the well pressure control system of FIG. 1B integrated with one embodiment of a system controller of a downhole tool movement control system of the disclosure.

FIG. 2A is a schematic block diagram of the well pressure control system of FIG. 1B integrated with one embodiment of a system controller of a downhole tool movement control system of the disclosure.

Figure 2B:
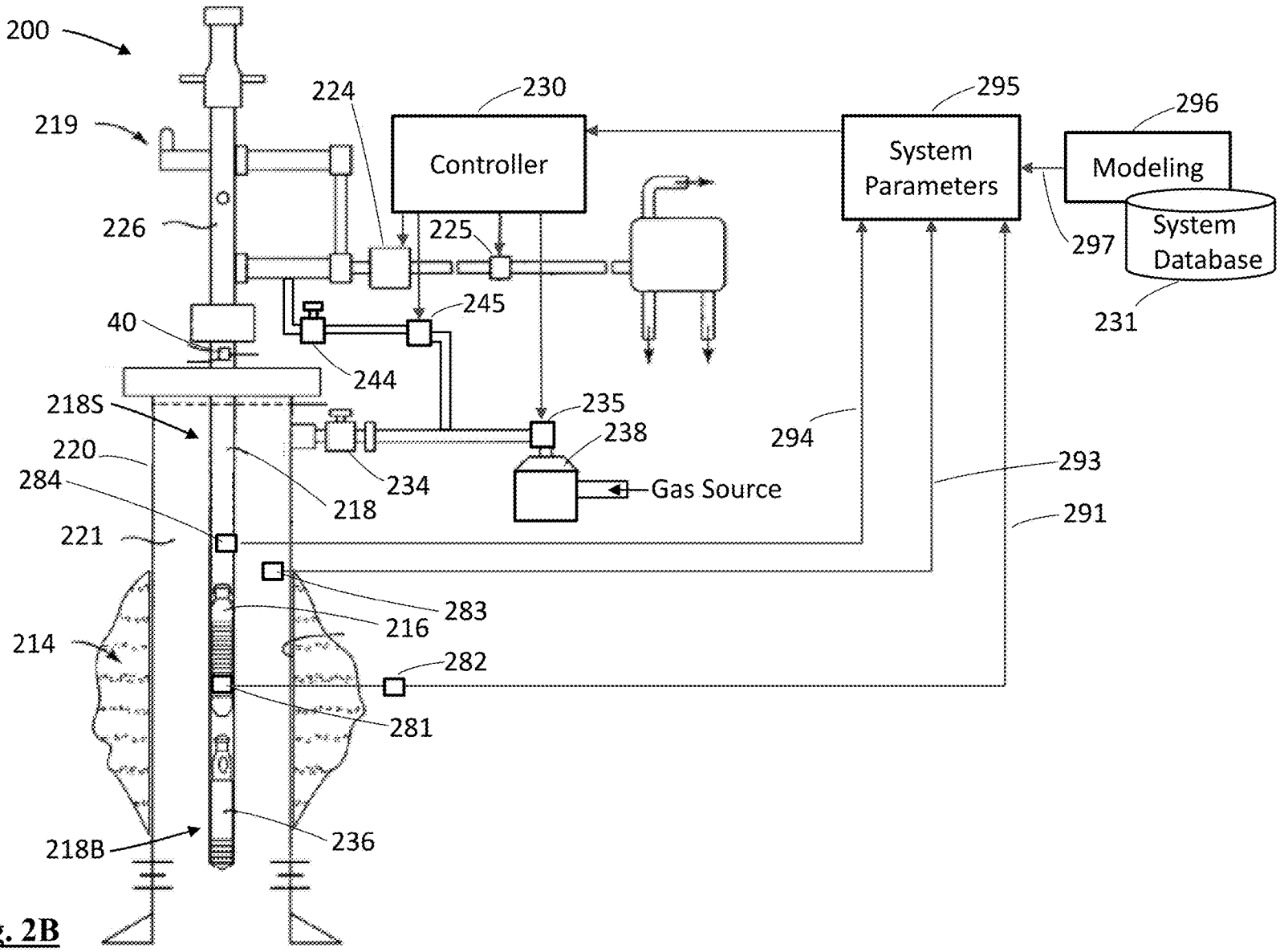
FIG. 2B is a side view representation of one embodiment of a downhole tool movement control system of the disclosure.
Figure 3:
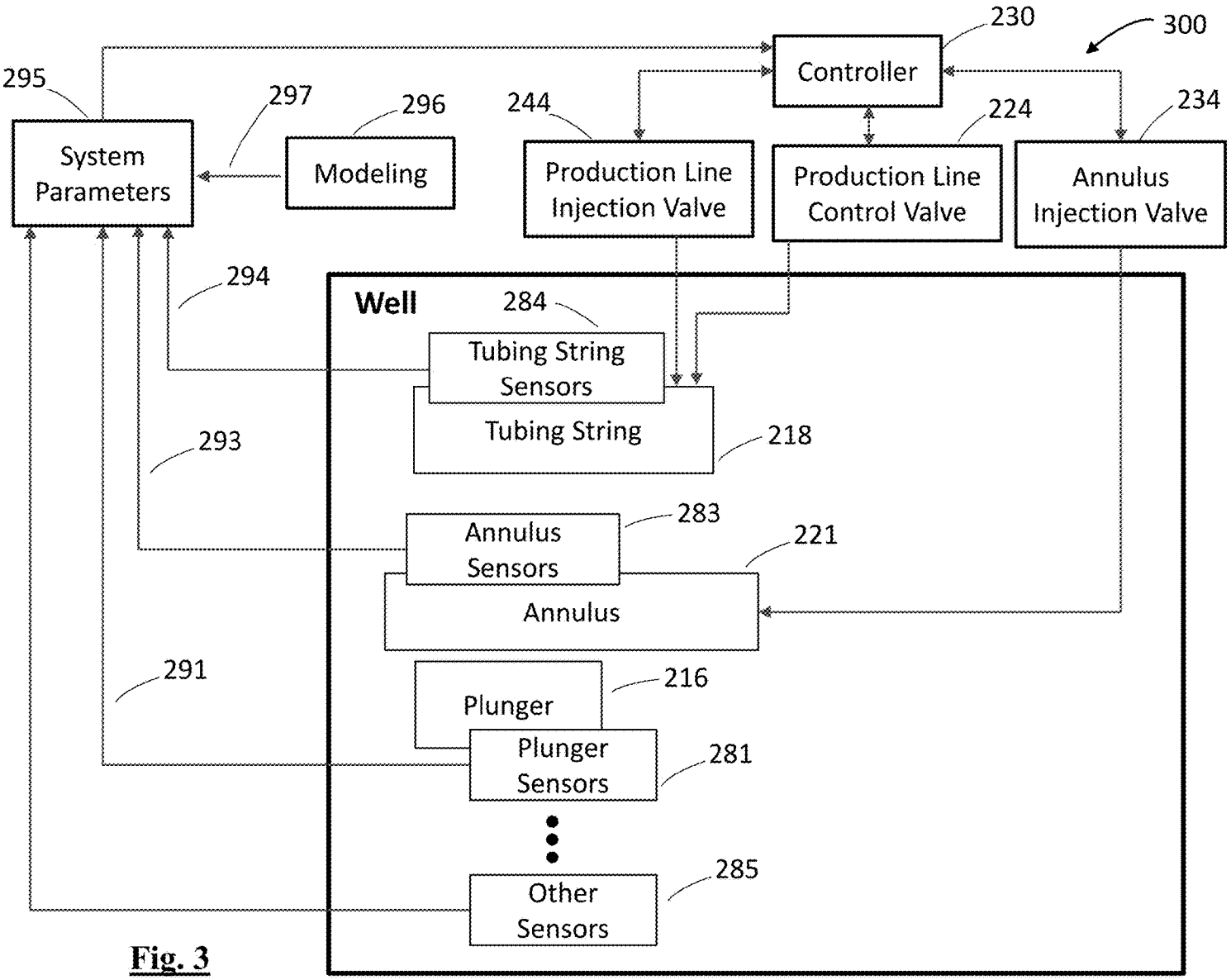
FIG. 3 is a schematic block diagram of the downhole tool movement control system of FIG. 2B.
Figure 4:
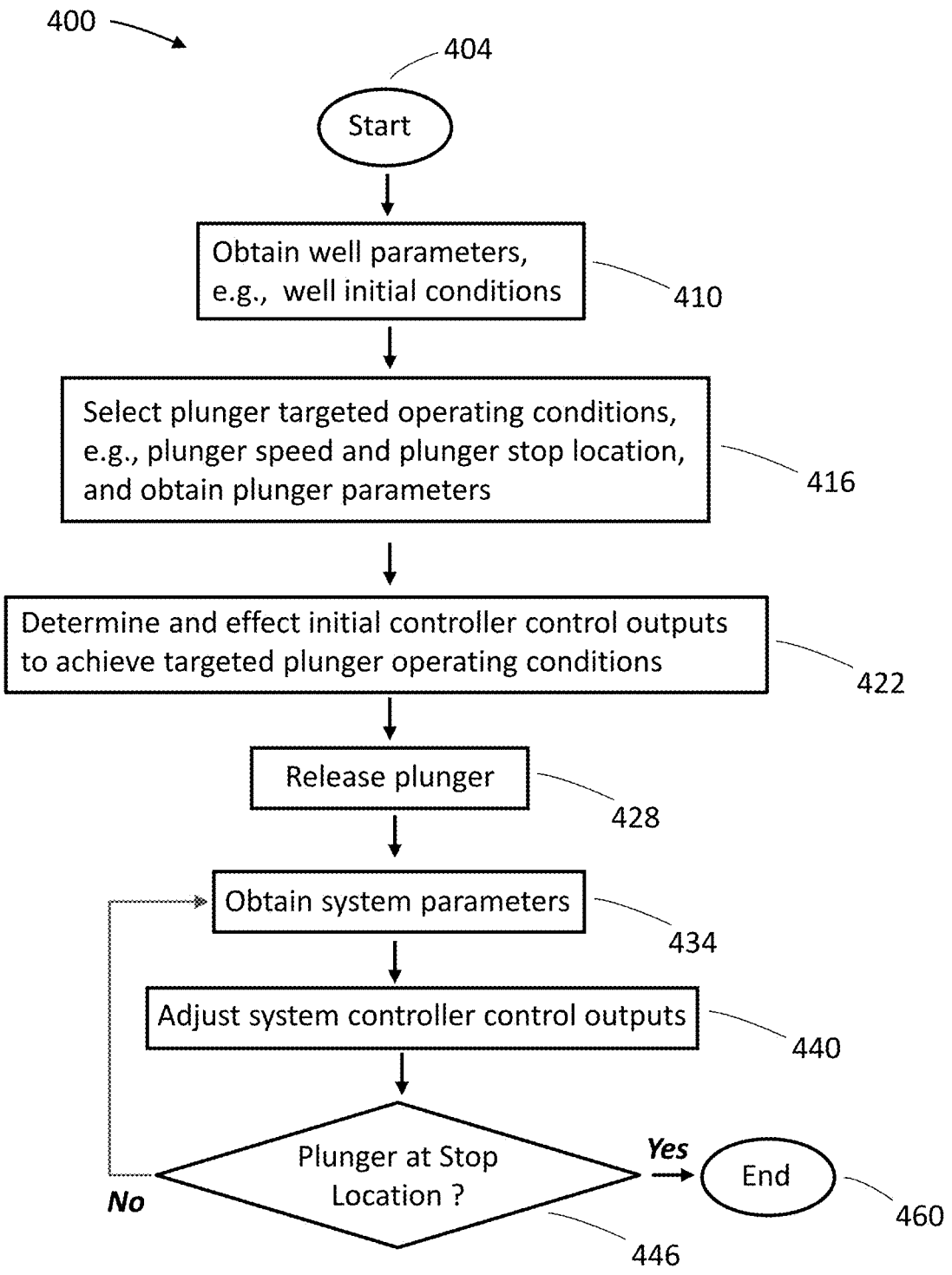
FIG. 4 depicts a flowchart of a method of use of the downhole tool movement control system of FIG. 2B.

FIG. 2B and FIG. 3 are a respective side view representation and a schematic block diagram of one embodiment of downhole tool movement control system. FIG. 4 is a flowchart of one method of use of the downhole tool movement control system of FIGS. 2 and 3.

FIG. 2B depicts a well system in a format similar to that of FIG. 1A with several similar components e.g., the well 214 and plunger 216 of FIG. 2B are akin to the well 14 and plunger 16 of FIG. 1, However, FIG. 2B depicts several features that are unique to a downhole tool movement control system 200, 300 as described below. FIG. 3 presents a schematic block diagram representation of the same downhole tool movement control system 200 of FIG. 2B yet is referenced as downhole tool movement control system 300 due to the alternate representation.

FIG. 4 is a method of use applicable to each of the representations of the downhole tool movement control system 200, 300. Note that some steps of the method 400 may be added, deleted, and/or combined. The steps are notionally followed in increasing numerical sequence, although, in some embodiments, some steps may be omitted, some steps added, and the steps may follow other than increasing numerical order. Any of the steps, functions, and operations discussed herein can be performed continuously and automatically.

With attention to FIG. 2A, the conventional well pressure control system of FIG. 1B is integrated with one embodiment of a system controller 230 of a downhole tool movement control system of the disclosure, such as the downhole tool movement control system 200 of FIG. 2B or the downhole tool movement control system 300 of FIG. 3.

The system controller 230 may comprise a computer processor, the computer processor having machine-executable instructions to operate aspects and/or functions of the downhole tool movement control system.

The system controller 230 interacts or integrates with the control computer or RTU to receive or read data from the RTU (and/or a SCADA or any other conventional processor associated with a typical well, as known to those skilled in the art), depicted as RTU read data 230*r*. The system controller 230 interacts or integrates with the RTU to output or write data to the RTU (and/or a SCADA or any other conventional processor associated with a typical well, as known to those skilled in the art), depicted as RTU write data 230*w*. The RTU read data 230*r* and the RTU write data 230*w* are continuous or near-continuous data feeds, e.g., data provided at a set sampling rate such as 1 Hz, for example. The RTU read data 230*r* may include gas rate, tubing pressure, and/or line pressure. The RTU write data 230*w* may include system valve 224' setpoint (a flow rate, a pressure, e.g.). The system valve 224' setpoint is continuously or near continuously determined by the system controller 230 (as described below, in any of various ways) so as to continuously or near continuously adjust the system valve 224' value or setting. (As the operations of the system controller 230 are typically digital rather than analog, the term continuous means at a consistent selectable rate, such as 1 Hz).

Note that the communications between the system controller 230 and the RTU (and/or SCADA) may use any communication means known to those skilled in the art, to include commercially available standard module bus communications of RTUs. In some embodiments, a single system controller 230 may operate a set of wells, to include interacting or integrating with a set of RTUs and/or a set of SCADAs. In some embodiments, the system controller 230 operates a plunger through one or both of a fall and a rise. In some embodiments, the system controller 230 operates a plunger through a cycle of rise and fall or fall and rise. In some embodiments, the system controller 230 operates a plunger through a series of rise/fall or fall/rise cycles. In some embodiments, the system controller 230 operates a plunger continuously, meaning at all or most times that the plunger is operating in a well.

The system controller 230 also receives fixed well parameters 11, as described above. In one embodiment, the system controller receives additional operational or other data from the fixed well parameters 11 (e.g., temperature at locations of the tubing string, such as at the well head). The system controller may interact with one or both of a system database 231 and a remote user device 232.

The system database 231 may be a physical server and/or a cloud-based system. a physical database operating partially or completely in the cloud. (The phrase "cloud computing" or the word "cloud" refers to computing services performed by shared pools of computer resources, often over the Internet). The system database may perform or assist in any of several functions. For example, the system database 231 may store historical data as to well operation, to include plunger operation with respect to a set of system and/or well parameters, and/or modeling parameters such as those used in modeling element 296 (see below with respect to FIG. 2B). Specifically, the system database 231 may store plunger velocity $v_p$ with respect to well parameters along all or a portion of a rise cycle, a fall cycle, a rise/fall cycle, and/or a fall/rise cycle. The system database 231 may store tables and/or mathematical models of plunger velocities $v_m$ as a function of system and/or well parameters. Note that the system and/or well parameters references may include all or some of the fixed well parameters described above.

The remote user device 232 may be a portable device such as a portable computer, smart phone or tablet computer or may be a fixed device such as a desktop computer. The remote user device 232 comprises a user interface to enable a user to control or operate or monitor the system controller 230 and therefore control or operate or monitor the downhole tool movement control system. (The phrase "user interface" or "UI", and the phrase "graphical user interface" or "GUI", means a computer-based display that allows interaction with a user with aid of images or graphics). The remote user device 232 may comprise an app to facilitate or enable user interaction with the system controller 230. (The word "app" or "application" means a software program that runs as or is hosted by a computer, typically on a portable computer, smart phone or tablet computer and includes a software program that accesses web-based tools, APIs and/or data).

Experimental data comparing the operation of a conventional well pressure control system of FIG. 1B with a conventional well pressure control system integrated with a system controller 230 of a downhole tool movement control system of the disclosure illustrates features and benefits of the downhole tool movement control system.

A plunger was operated in a well and plunger velocities experimentally measured during two rise cycle runs. Plunger velocity as measured by one or more sensors may be referenced as vs.

In a conventional well pressure control system of FIG. 1B, the plunger setpoint velocity ($v_{set}$) was set to 850 fpm. The system valve 24, as set by the RTU 20, was set to fully open (and as is standard, remained in this position throughout the plunger rise cycle). The RTU and/or SCADA reported, for respective run 1 and run 2, a plunger velocity of 990 fpm and 996 fpm. These plunger velocities are presented as average velocities of the plunger (i.e., $v_{ave}$) and are typically based on a very limited set of measurements, such as the time from the assumed departure from the BHA to arrival as sensed at the wellhead. The experimentally measured plunger velocities recorded extremes in actual plunger velocities for run 1 of 857 fpm at open plunger (at BHA, dubbed bottomhole velocity) and 1,364 at plunger arrival (at well head, dubbed surface velocity), and, for run 2, of 892 fpm at open plunger (BHA) and 1,940 fpm at plunger arrival. Such extremes in plunger velocity, as described above, are inefficient at best as to drawing out well fluids, and at worst are dangerous given the potential for well head damage upon receipt of a high velocity plunger at the well head.

In contrast, the well pressure control system of FIG. 2A, with the addition of the system controller 230 and ability to vary the system valve 224' setting (e.g., the valve pressure) as the plunger travels through its rise cycle, results in a much more uniform velocity profile and with much reduced end point velocity values. Specifically, the same conditions as described above were repeated for two runs, except that the plunger setpoint $v_{set}$ was set to 800 fpm. The system valve 224' operated at 80% open for the first 30 seconds of the (rise) run, then employed the calculated flow rates as determined by the system controller 230 to control plunger velocity by way of system valve 224' setting/control for the rest of the plunger rise. The experimentally measured plunger velocities recorded extremes in actual plunger velocities for run 1 of 1,001 fpm at open plunger and 760 fpm at plunger arrival and, for run 2, of 969 fpm at open plunger and 717 fpm at plunger arrival. The RTU and/or SCADA reported, for respective run 1 and run 2, a plunger velocity of 920 fpm and 898 fpm.

Note that the system valve 224' setting may comprise a set of settings, to include valve position, or valve flow rate setting (to achieve a selectable flow rate). The system valve 224' in some embodiments is any device that measures, adjusts, and/or controls flow and/or pressure associated with the system valve 224'. The system valve 224' may be, for example, a pressure differential device, output voltage from a turbine meter, or any other flow measurement devices or methods known to those skilled in the art.

In one embodiment, a user may select a minimum downhole tool velocity of 250 fpm. In one embodiment, a user may select a maximum downhole tool velocity of 2000 fpm. In another embodiment, the user may select a maximum downhole tool velocity of 1200 fpm. In one embodiment, a user may select an average downhole tool velocity of between 300 and 1500 fpm. In a more preferred embodiment, a user may select an average downhole tool velocity of between 400 and 1200 fpm. In a most preferred embodiment, a user may select an average downhole tool velocity of between 500 and 900 fpm.

With attention to FIGS. 2B and 3, a set of two more detailed schematic block diagrams of the well pressure control system of FIG. 1B integrated with one embodiment of a system controller 230 of a downhole tool movement control system 200, 300 are presented. Note that, among other things, the system valve 224' of FIG. 2A includes valves 224, 244, and 234. Also, system database 231 of FIG. 2A, depicted in FIG. 2B as a portion or sub-component of modeling element 296, may be in direct communication with one or more of controller 230 and system parameters 295 element, and/or may be a portion or sub-component of one or more of controller 230 and system parameters 295 element. Well 214 is located near or adjacent a hydrocarbon deposit. In some embodiments, the well is other than a hydrocarbon deposit, such as a water well or helium well.

The well 214 may be encased in one or more concentric well casings 220. The innermost is typically known as the Production Casing and is in direct contact with the producing zone. Within the well casing 220, a series of tubes or a continuous tube such as coiled tubing, are inserted to form a tubing string 218. The tubing string comprises a surface tubing string portion (or upper tubing string portion or first tubing string portion) 218S disposed at the upper region of the tubing string. The tubing string 218 comprises a bottom tubing string portion (or lower tubing string portion) 218B disposed at the bottom region of the tubing string. The bottom tubing string portion 218B may fully or partially encircle a downhole stop 236.

Note that in some well configurations, fluid (e.g., a gas, liquid, or gas/liquid combination) may enter the tubing string above the end of the tubing string, meaning above the end of the lower string portion 218B, and/or through perforations or punctures above the end of the tubing string to provide cavities or voids that enable gas to enter the tubing string; such configurations are assembled, e.g., during "gas lift" plunger operations. Such injection of fluid may be performed by a fluid injection device that may adjust fluid injection pressure values based on controller signals. The fluid injection device receives fluid from gas compressor 238 (described below). A plunger 216 operates within the tubing string 218. The range of travel of the plunger 216 may vary between the surface tubing string portion 218S and the bottom tubing string portion 218B. Note that the range of travel of the plunger at the lower end of the tubing string often is determined by setting a mechanical "stop" at some intermediate selectable point and/or selectable range. Such a stop also may be placed, for example, between 25% to 80% of the full tubing string to prevent the plunger from descending to a region that will not support the upward return of the plunger.

The cylindrical gap between the well casing 220 and the tubing string 218 is called the annulus 221. Gas or other fluid may exist in the annulus 221. Supplemental gas may be supplied by gas compressor 238 by way of gas injection control valve 234 to the annulus 221 and/or to the tubing string 218. (Note that the supplemental gas from the gas compressor 238 may be supplied in any number of ways, to include as a stand-alone supply and/or by way of the well. For example, the supplemental gas may be supplied by way of a downstream separator which recirculates gas back into the well. Gas lift systems work this way as do combination systems such as Plunger Assisted Gas Lift.) Gas or other fluid may flow between the annulus 221 and the tubing string 218, e.g., entering at or near the bottom tubing string portion 218B. Gas or other fluid may also flow between the annulus 221 and tubing string through one or more gas-lift valves placed at intermediate intervals along tubing string 218. The annulus 221 may comprise one or more annulus sensors 283, such sensors providing, e.g., a measure of gas or other fluid pressure at a particular location within the annulus 221. The one or more annulus sensors 283 provide annulus sensor signals 293 to system parameter element 295.

The tubing string 218 may comprise one or more tubing string sensors 284, such sensors providing, for example, a measure of plunger 216 (vertical or well) location $z_p$ within the tubing string 218 (such as by way of techniques discussed in Bender, for example), plunger 216 measured or sensed speed vs and/or a measure of tubing string 221 parameters, such as gas or other fluid pressure at a particular location within the tubing string 218. The one or more tubing string sensors 284 provide tubing string sensor signals 294 to system parameter element 295. In one embodiment, tubing string sensors 284 are positioned at one or more connection joints (aka collars) between tubing string portions.

Plunger 216 may include one or more plunger sensors 281, such plunger sensors 281 providing a measure of tubing string 218 parameters, such as gas (or other fluid) pressure or temperature within the tubing string, or measures of plunger kinematics, such as plunger sensed or measured speed vs and plunger location $z_p$ at a given point, a series of points, a selectable set of points or selectable collection of tranches of points, or over the entire range of plunger travel. In one embodiment, the plunger sensors may include an acoustic sensor, such as an Echometer™, image sensors in various bands such as visible, ultraviolet, and infrared, gyroscopic or proximity sensors, and the like, as known to those skilled in the art.

The plunger sensors 281 may create or enable creation of a speed profile of the plunger, the speed profile based on past operations and/or providing a predictive speed profile of plunger operations. (As may be stored in system database 231 and/or as part of modeling 296 element). Dynamic or real-time (or near real-time) measures may be derived from or sensed by one or more sensors which provide information on tool state (e.g., location and/or velocity), such as one or a plurality of accelerometers, magnetic orientation, other geo-spatial devices, and sensors known to those skilled in the art. The one or more plunger sensors 281 may broadcast or communicate sensed or calculated measurements to a plunger relay 282 which in turn may be connected or in communication with system parameter element 295. The one or more plunger sensors 281 provide plunger sensor signals 291 to system parameter element 295.

The downhole tool movement control system has a set of system parameters 295. The system parameters may include both well parameters and plunger parameters. The set of system parameters may be acquired by any of several means, to include one of more of the above-identified sensors and/or other sensors 285 and through the modeling 296 element. Other sensors 285 may include, for example, a sensor that measures the gas (or other fluid) pressure at the bottom of the well, i.e., the $P_{BH}$, the line pressure at the wellhead 219, and/or line pressures at other locations along the production line.

The system parameter element 295 may also receive system parameters from modeling element 296, which may model various system parameters, such as modeling of fluid pressures and/or fluid velocities.

Any number or variety of modeling techniques may be used, to include deterministic modeling, classic Newtonian modeling, stochastic modeling, multiphase flow modeling, adaptive modeling to include artificial intelligence and machine learning, computational fluid dynamic modeling, and/or modeling techniques known to those skilled in the art. The system (well) parameters may include fluid pressures and/or fluid velocities in the tubing string at one or more locations, fluid properties such as temperature, fluid dynamic conditions, and gas/liquid mixtures such as proportion of gas to liquid. The system (plunger) parameters may include plunger speeds or plunger velocities, and/or plunger modeled or nominal velocity $v_m$ for given well conditions (such as, e.g., average well tubing pressure). Note that one or more of the system parameters may vary with position in the production line, e.g., a plunger speed typically varies with position in the production line and may reach a peak at an intermediate position within the production line or near/adjacent the upper portion of the production line.

In one embodiment, the system (plunger) parameters include $v_m$ as modeled over a portion or entirety of the well, for a given set of well conditions, as provided by a "fall rate calculator" or similar model of plunger kinematics. The fall rate (or rise rate) may be calculated or modeled using any method known to those skilled in the art, to include by way of CFD modeling techniques. In one embodiment, the fall rate and/or rise rate of a given plunger may be determined with input of one or more of the following parameters: tubing Pressure (psig), temperature, tubing Size, SG (specific gravity) of Gas, SG of Liquid, depth of EOT (ft), Average Barrels of Liquid Per Day (bbls), Trips Per Day, plunger type, tubing pressure, input depth of tubing the plunger will travel, number of barrels per day of liquid produced, and number of trips per day the plunger makes.

The modeling may be combined or augmented by measurements, such as measurements provided by the one or more plunger sensors 281 described above. The term "modeling" means a mathematical or logical representation of a system, process, or phenomena, such as a mathematical representation of the kinematics of a plunger operating within a production line given operation conditions. Modeling therefore includes without limitation, any method of calculating or predicting flowing fluid parameters in the well, particularly in the physical proximity of the plunger during movement of the tool, such as multiphase flow correlations known to those skilled in the art, and Machine Learning or Artificial Intelligence-based methods to obtain similar flowing fluid parameters.

The kinematics of the plunger (to include in particular plunger velocity $v_p$ at one or points within the tubing string and/or plunger location $z_p$ at one or points within the tubing string, through techniques to include sensor measurements and/or modeling, are thus monitored and/or predicted for use by the downhole movement control system. The plunger kinematics are controlled by the downhole movement control system so as to operate the plunger at the $v_{set}$. Such plunger kinematics may comprise actual or sensed plunger kinematic profiles and/or predictive plunger kinematic profiles. Other plunger characteristics and/or production line parameters and/or system parameters may also be observed, sensed, and/or predicted, such as production line fluid pressures at one or more positions of the production line, production line fluid temperatures at one or more positions of the production line, and the like. A given set of system parameters, to include the plunger kinematics aka plunger parameters, may be controlled by the downhole movement control system (with controllability achieved through operation or control of the system valve 224' and one or more of valves 224, 244, 234), by any number or set of control techniques using any number of or set of control parameters. For example, the plunger velocity may be controlled through classic feedback control techniques using plunger velocity sensors and plunger internal flow control mechanisms (e.g., mechanisms that control flow through the plunger which will influence the plunger speed) that slows or speeds up the plunger velocity. Other control techniques are possible, such as those mentioned above, e.g., deterministic control, adaptive control, etc. Other control parameters, alone or in combination are also possible, to include control, monitoring, sensing, and/or modeling of production line parameters, to include, e.g., fluid temperature, fluid pressure, etc. at one or more positions in the production line.

In one embodiment, one or more of the set of system parameters 295 may be obtained through one or more sensors fitted to the downhole tool (as described above), and/or as disposed on or near the production line or on or near the wellhead, as described by, for example, in Bender.

The system (well) parameters 295 may include any of several characteristics of well operations, such as, for example: makeup of gas and liquids (stated another way, the relative proportion of gas and liquid), well bottom temperature, fluid phases or mixtures thereof, fluid characteristics such as density, viscosity, pressure, speed/velocity, etc.; physical characteristics of the tubing string e.g. diameter, tubing material, tubing condition (new, corrosion, erosion), depth of tubing placement, inclination, and tortuosity; surface conditions e.g. wellhead temperature, piping and valve arrangements, gathering or receiving system pressures and temperatures, production line pressure at or near the wellhead (e.g. production gas pressure, production liquid pressure, production gas/liquid pressure) which may be measured by electronic flow meters (EFM) 225, 235, 245 (see FIG. 2B); downhole conditions such as gas pressure within the tubing string at one or more locations or depths within the tubing string or within the annulus, gas velocity or gas speed within the tubing string at one or more locations or depths within the tubing string or within the annulus; and plunger parameters such as plunger speed, plunger location, and ideal or optimal plunger speed given tubing string or other well conditions. Any set or all of the system parameters may vary with location in the production string.

The downhole tool, such as plunger 281, is configured to travel freely within the tubing string 218 between a first tubing string portion (e.g., the uppermost tubing string as connected with the wellhead, i.e. tubing string portion 218S) and a second tubing string portion (e.g. the lowermost tubing string as coupled to the bottom of the well and in receipt of fluid from the hydrocarbon deposit, i.e. tubing string portion bottom 218B). This is defined as the "fall" portion of the cycle. This is followed by the "rise" portion of the cycle whereby the downhole tool is driven by fluid pressure and velocity from the bottom string portion 218B and the upper string portion 218S or wellhead. The "rise" portion of the cycle comprises the actual pumping action of a plunger in plunger lift and is the primary action we seek to control.

The downhole tool, e.g., a plunger, is typically engineered to optimally operate during the "rise" portion of the cycle within a speed range and/or at a given speed value. Such speed may be deemed a target speed range or a target speed value. In one embodiment, the plunger optimal speed is between 600-900 feet per minute (fpm). Typical Plunger optimal speeds are known to those skilled in the art as a function of plunger type and plunger operating (e.g., well) conditions. Plunger optimal speeds are also often determined through trial and error, or by empirical methods as may be observed by comparing production results with various speed settings. An operator or system user typically seeks a desired set point velocity for the plunger ($v_{set}$) of a range of velocity for the plunger e.g., within a set percentage of speed range of the $v_{set}$. Such set point data may be provided by a user via an app and/or via user interface 232 of FIG. 2A. The operator or system user may also seek operation of the plunger at a selectable velocity of speed profile (see FIGS. 5B-D and associated description below).

A production line control valve 224 is located at the well head 214 area and may be adjusted to influence flowing volumetric rates and pressure values within the production line such as tubing string 218. (In one embodiment, the production line control valve 224 may operate or function in the manner described above with respect to system valve 224' of FIG. 2B). The production line control valve 224 may be in communication with a production line electronic flow meter (EFM) 225. The production line gas injection EFM 225 may monitor and/or measure line pressure at the well head 219 and is in communication with the system controller 230. The production line control valve 224 is in communication with system controller 230. In some embodiments, the relative location of the production line gas injection EFM 225 and the production line control valve 224 are exchanged, meaning that one may be either upstream or downstream of the other. System controller 230 may be referred to as "controller."

One or more supplemental gas volume valves may be fitted to the system 200, 300. (In one embodiment, one or both of the supplemental gas volume valves 234, 244 may operate or function in the manner described above with respect to system valve 224' of FIG. 2B). In the embodiments of FIGS. 2 and 3, two supplemental gas volume valves are fitted to the system: a production line injection valve 244 (which injects gas into the production line) and an annulus injection valve 234 (which injects gas into the annulus). Collectively, the production line injection valve 244 and the annulus injection valve 234 are referred to as "supplemental gas volume valves." Each of the supplemental gas volume values receive supplemental gas from gas compressor 238, the gas compressor 238 receiving gas from a gas source.

Gas provided from gas compressor 238 is provided to the production line by way of production line injection valve 244, the production line injection valve 244 controlled by the system controller 230. The system controller 230 may control the gas provided to production line injection valve 244 with aid of and/or with measurements provided by the production line gas injection electronic flow meter (EFM) 245.

Gas provided from gas compressor 238 is provided to the annulus by way of annulus injection valve 234, the annulus injection valve 234 controlled by the system controller 230. The system controller 230 may control the gas provided to annulus injection valve 234 with aid of and/or with measurements provided by the annulus gas injection electronic flow meter (EFM) 235.

The annulus injection valve 234 may be in communication with annulus gas injection electronic flow meter (EFM) 235, which in turn is in communication with controller 230. In one embodiment, the annulus injection valve 234 is in direct communication with controller 230. In some embodiments, the relative location of the annulus gas injection electronic flow meter (EFM) 235 and the annulus injection valve 234 are exchanged, meaning that one may be either upstream or downstream of the other.

In some embodiments, the annulus gas injection electronic flow meter (EFM) 235 is located downstream of the split of the gas injection line feeding the production line gas injection line which comprises electronic flow meter (EFM) 245 (see FIG. 2). In some embodiments, each of the production line gas injection line and the annulus gas injection line are separate lines which directly connect to the gas compressor 238. In some embodiments, the production gas injection line uses gas from the annulus gas injection line independently of the compressor.

As discussed above, the supplemental gas volume may be supplied to the annulus 221 of a well to the bottom or to some intermediate point of the well, or to multiple intermediate points of the well between the upper portion 218S and the lower point 218B (to include, for example, injection into the production line at or near the upper portion of the production line) wherein the gas enters the tubing string 218 at the production string at that point 218B, thereby increasing gas pressure and gas flow into the production string at that point of the well. Such supplemental gas may be employed to control the plunger 281 movement within the tubing string 218.

The production line control valve 224 and/or the supplemental gas volume control valves 234, 244 may adjust in any of several ways, to include simple fully on or fully off aka on/off configuration, a selectable maximum value and a selectable minimum value, and variable settings within a percentage on fully open (100%) to fully closed (0%). Other valve configurations known to those skilled in the art are possible.

The system controller 230 operates to control the production line control valve 224 and/or the supplemental gas volume control valves 234, 244 between valve settings in any of several ways, to include on/off aka full open/full close control, proportional control, PID aka proportional-integral-derivative control, adaptive control, artificial intelligence or machine learning, adaptive control, stochastic control, and any control schemes known to those skilled in the art (to include control schemes identified above regarding controllers and/or control systems).

The system controller processes a received set of system parameters 295, such as tubing string parameters and other such parameters as identified above (to include plunger parameters), and communicates controller signals associated with the set of system parameters to the production line control valve 224, the supplemental gas volume control valves 234, 244, and/or the electronic flow meters (EFM) 225, 235, 245, wherein the production line control valve 224 and/or the supplemental gas volume control valves 234, 244 adjust conditions within the tubing string 218 to effect and control the movement of the plunger 216, namely the plunger velocity.

In one embodiment, the system controller 230 operates or controls movement of the plunger 216 (such as the $v_p$) using a controller schedule created through calibration of plunger operations. The kinematics of a plunger are first documented or recorded against well conditions throughout a given plunger cycle, meaning throughout a particular fall and rise cycle of a plunger, representing the notional or modeled plunger kinematics, such as notional or modeled $v_m$ for a given set of well and/or plunger parameters. These data may be obtained through any of several means, to include, e.g., an instrumented plunger, modeling, a series of sensors on the tubing or in the annulus, or through continuous sensing in the wellbore (e.g., fiber optic cable, tech line, e-line). These plunger predicted or notional or modeled kinematics (location and velocity) data are transmitted to a processor (such as processor 233 of controller 230) which correlates or calibrates the data with respect to actual well data (such as well flow data, injection valve rates, etc.) for that particular plunger cycle. The data may be transmitted in real-time or captured and transmitted periodically (e.g., the plunger may only transmit data at the apex of a rise). The processor 233 may be a stand-alone processor and/or the system controller 230, and/or may be stored or processed as part of or in coordination with the system parameters 295. The resulting correlated or calibrated set of data form a controller schedule that maps or relates plunger kinematics as a function of well data or well conditions, thereby enabling the system controller to control plunger movement. The downhole tool movement control system thus "learns" how the plunger responds to variations in controller outputs and creates an operating control map. Note that once the controller map or controller schedule is created, the described instrumentation may no longer be required. For example, if the data were obtained through an instrumented plunger, the instrumented plunger could then be replaced with a non-instrumented plunger. With use of the control map or controller schedule, the downhole tool movement control system may operate variable-rate control of a plunger without need of sensor inputs other than flowrate and time from a point in the cycle.

The control of the plunger velocity $v_p$ to a desired set velocity $v_{set}$ by way of the system controller 230 may be described with attention to the monitoring or determination of the actual plunger velocity $v_p$. As described above, the system controller adjusts one or more valves 224, 234, 244 so as to adjust one or more well parameters to effect or control the kinematics of the plunger, such as plunger velocity $v_p$ to a desired set velocity $v_{set}$.

The "actual" plunger velocity $v_p$ (or more precisely, the plunger velocity input used by the system controller 230 to effect control of the plunger velocity) may be determined in any of several ways, to include empirical tables (aka look-up tables), tabled correction factors, instrumentation or sensors, and various modeling techniques.

A set of empirical tables may be constructed, as may be stored in the system database 231, of plunger velocities $v_p$ at a set of tubing locations $z_p$ for a given set of plunger parameters and well parameters. For example, a table may be constructed that presents a set of paired plunger velocities at tubing locations (e.g., at fifty such locations) for a given set of plunger parameters (e.g., a specific plunger type) and well parameters (e.g., tubing pressure, line pressure, etc., as described above). As such, once it is known (by, e.g., conventional means of identifying plunger at end points—well bottom and well head) the start and stop plunger state, the plunger velocity may be used as an input for control of the plunger by the system controller 230 (via one or more system valves). The look-up tables thus provide a control input to the system controller 230 to effect control of the plunger 216.

A set of tabled correction factors $K_v$ may also be used to control the plunger velocity. In this approach, the actual plunger velocity $v_p$ is determined by applying a particular correction factor $K_v$ for a given set of plunger parameters and/or well parameters as applied to a notionally determined plunger velocity $v_m$ determined by any of several means. For example, the notionally determined plunger velocity $v_m$ may be determined through the fall rate calculator as described above, with Kv established as a function of the parameters used by the fall rate calculator as described above. In this manner, the tabled correction factor adjusts the notional plunger velocity as described by: $v_p=(K_v)v_m$. Correction factors may also include factors to account for changes in liquid load as determined by pressure measurements, or by other sensors or measurement devices.

A set of tables or maps or other optimization representations may also be employed, such tables or maps generated through, in one embodiment, Machine Learning or Artificial Intelligence-based approaches that model plunger movement and direct changes to the operating algorithms of controller 230. In other embodiments. Such tables or maps are generated through historical data analysis of well operations, or other methods known to those skilled in the art.

A set of measured or sensed values of the location and velocity of the plunger while operating in the tubing string may also be used to control the plunger velocity to the desired set velocity. This is a classic control system approach, wherein sensor input values of the item to be controlled (the plunger) are directly measured and an output is determined (valve setting) so as to effect control. Such an approach has been described above. Note that in this approach, the plunger velocity $v_p$ used or employed as a control input to the system controller 230 is indeed an actual plunger velocity, to the degree a measured plunger velocity is an actual velocity without sensor measurement error. In one embodiment, considered an indirect control approach, sensor input values other than the item to be controlled are measured and used to effect control. For example, one or more well parameters may be measured so as to determine controller outputs to effect or control plunger velocity.

Various modeling techniques may also be used to determine the plunger velocity $v_p$ given well parameters and/or plunger parameters. In addition to the modeling techniques discussed above, the notional plunger velocity $v_m$ may be adjusted to account for or reflect one or more well parameters and/or plunger parameters, as described above. Such velocity adjustment factors may generically be referred to as $v_f$. For example, $v_f$ may include one or more of downhole conditions such as gas pressure within the tubing string at one or more locations or depths within the tubing string or within the annulus, gas velocity or gas speed within the tubing string at one or more locations or depths within the tubing string or within the annulus. In this manner, the actual plunger velocity, as used by the system controller 230 to control the plunger kinematics such as plunger velocity to a desired or set plunger velocity at various tubing locations $z_p$ or plunger depths, may be described by: $v_p=v_f-v_m$.

The above techniques for plunger control by the system controller may be combined, e.g., the value of $v_m$ as described in the immediately above velocity adjustment factor technique may be obtained or supplemented by use of, e.g., the described empirical table or Machine Learning or Artificial Intelligence techniques.

Note that in any or all of the above techniques, the downhole movement control system may adapt or learn or adjust or calibrate control values (e.g., to the system valve) based on actual performance or kinematics of the plunger. For example, an end-to-end measurement of rise time (from BHA to wellhead) may determine that the plunger's actual rise time is several seconds faster than predicted based on one of the above control techniques. The system controller may then adjust one or more parameters of its control technique to adapt to the disparity in rise time. For example, if the tabled correction factor $K_v$ technique was employed, the value $K_v$ may be slightly adjusted. Such an auto-correlation capability may be required when a different plunger is used than that identified by a user, or when, with time, a plunger changes its performance (e.g., the plunger with times develops a smoother or worn exterior surface, resulting in slightly reduced hydrodynamic drag and thus a slightly slower rise time.)

The system controller 230 may calculate the plunger velocity $v_p$ at any number of frequencies, to include a fixed frequency (e.g., 1 Hz, at least every 60 seconds) or a dynamic frequency (e.g., 10 Hz within a set distance from end points and 1 Hz elsewhere). The result of the downhole tool movement control system is control of the movement, e.g., the speed or velocity, of the downhole tool to within a target speed range and/or the target speed value of the downhole tool. The target speed range of the downhole tool may be selectable by the user. The control of speed of the plunger is performed by variation, by way of the system controller, of conditions within the tubing string, such as one or more of the above-identified system parameters and/or the system valve. Most commonly, the production string flowing conditions are controlled by varying the flow rate through valve 224, valve 234, and/or valve 244, if applicable.

In one embodiment, the downhole tool movement control system is used in a well that continues to flow i.e., produce such that the production line control valve 224 never completely shuts and both ascending and descending velocity of the plunger is controlled. In such a well scenario, the well continues to maintain a rising flow up through the well, yet the (bypass) plunger is regulated or controlled, by the downhole tool movement control system, to fall or descend against the flow of the well at a desired or selected speed until the plunger reaches a stop or turnaround point, after which the downhole tool movement control system switches to a "rise mode" and controls the rise velocity of the plunger. The controllability of the plunger is provided to the downhole tool movement control system by controlling the well flow rate (by, e.g., any of the above-described techniques, to include one or more injection valves, etc.). Note that in this embodiment, when the plunger is descending against the flow of the well, the plunger may be considered to have a negative velocity relative to the flow of the well, and to have a positive velocity relative to the flow of the well when the plunger is ascending with the flow of the well. FIG. 4 provides a method of use 400 of the downhole tool movement control system 200, 300. The method starts at step 404 and ends at step 460. Any set of the steps of the method 400 may be automated completely or partially.

After starting at step 404, the method 400 proceeds to step 410. At step 410, well parameters aka well state conditions are obtained. Such state conditions would include well configuration (e.g., casing diameter, tubing diameter, tubing depth, gas to liquid ratios, fluid properties, line pressure, pressure at bottom of the hole i.e., $P_{BH}$, etc.), availability of supplemental gas (see Scenario Two below), maximum allowable plunger speed within tubing string (e.g., to include at well head, at well bottom, and during transition between well head and well bottom), and acceptable range of plunger speed. After completion of step 410, the method 400 proceeds to step 416.

At step 416, the operator selects plunger operating conditions, e.g., target plunger speed, and target plunger stop or turn around location (see Scenario One below). The target plunger stop or turn around location may more generally be referred to as a physical downhole tool tubing string stop point or a desired turnaround point above a physical stop and selectable by a user. In one embodiment of the method 400, the stop location is at or near the BHA. After completing step 416, the method proceeds to step 422.

At step 422, the controller determines control outputs to achieve the targeted plunger operating conditions, e.g., to achieve a targeted plunger speed. The controller sets or determines the control outputs (the control outputs used to control the tubing line pressure valve 224 and/or the supplemental gas volume valves 234, 244) to control the plunger movement in the tubing string. The control outputs are influenced or established by one or more of the system parameters 295 and any of the techniques described above regarding determination of the plunger actual velocity $v_p$. For example, the control outputs may be influenced or established by use of or differences between one or more system parameters, the system parameters described above. In another example, plunger kinematics may be controlled by control or management of one or more of the identified system parameters, to include characteristics of the production line, such as production line fluid velocity, etc. After completing step 422, the method proceeds to step 428, wherein the plunger is released into the production line (here, a tubing string), e.g., the plunger may be released from the well head 219 to descend toward the bottom of the well, or the plunger may be released to ascend the well from an interim location or any location within the tubing string (see Scenario Two). After completing step 428, the method proceeds to step 434.

At step 434, as the plunger is moving within the tubing string (such as in a rise or in a fall), the system receives or obtains or determines one or more system parameters and/or plunger kinematic properties, such as $v_p$ and/or $z_p$ as described above. More specifically, the controller 230 receives one or more updated or additional system parameters. For example, the controller may receive one or more measurements of speed of the plunger 216 from the plunger sensor 281. After completing step 434, the method proceeds to step 440.

At step 440, as a result of receiving updated or new system parameters and/or plunger kinematic properties, the controller determines adjusted control outputs to provide to the production line control valve 224 and/or the supplemental gas volume valves 234, 244. The controller 230 control signals result in adjustments to the production line control valve 224 settings and/or the supplemental gas volume valves 234, 244 settings, resulting in control of the plunger movement in the tubing string. After completing step 440, the method proceeds to step 446.

At step 446 a query is made to determine if the plunger is located at the desired plunger stop location (see Scenario One); if the result is NO, the method 400 proceeds to step 434 and continues to loop until the result is YES, then the method 400 proceeds to step 460 and the method 400 ends.

Figure 5A:
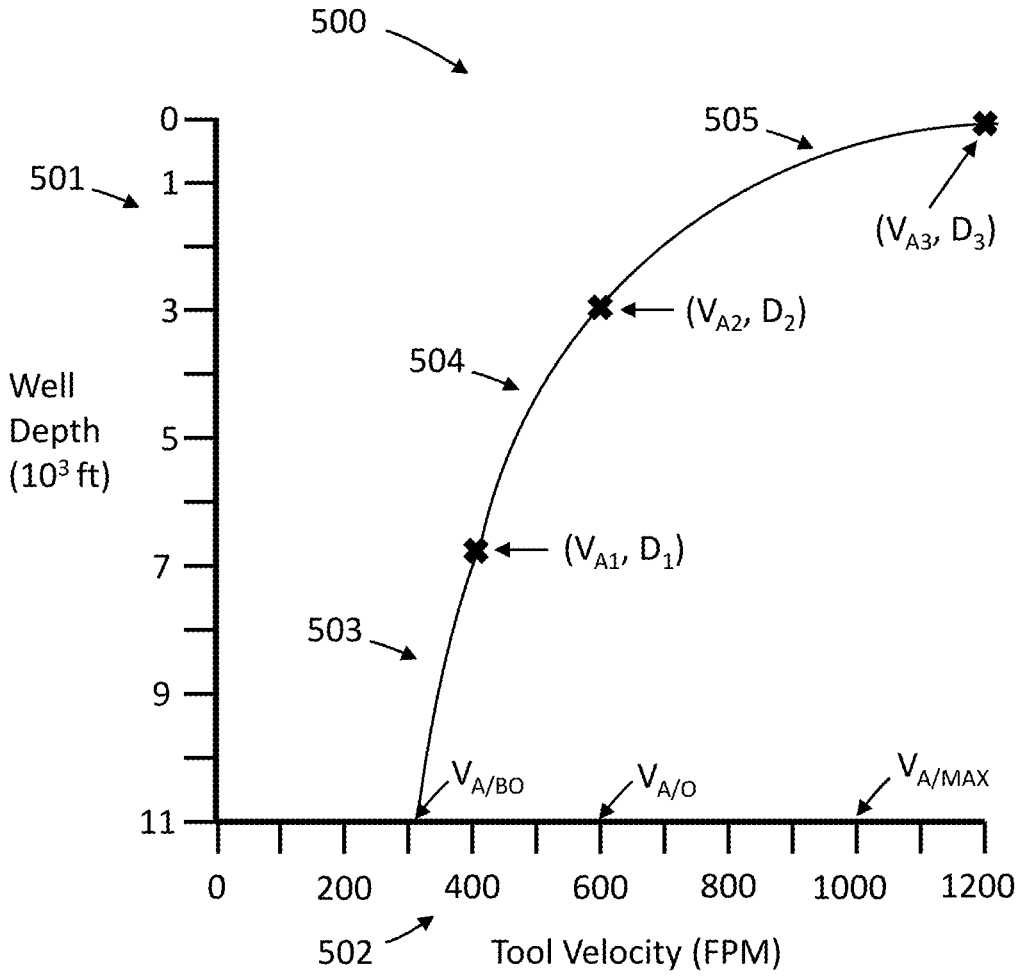
FIG. 5A depicts a representative conventional velocity profile of a downhole tool of the prior art.
Figure 5B:
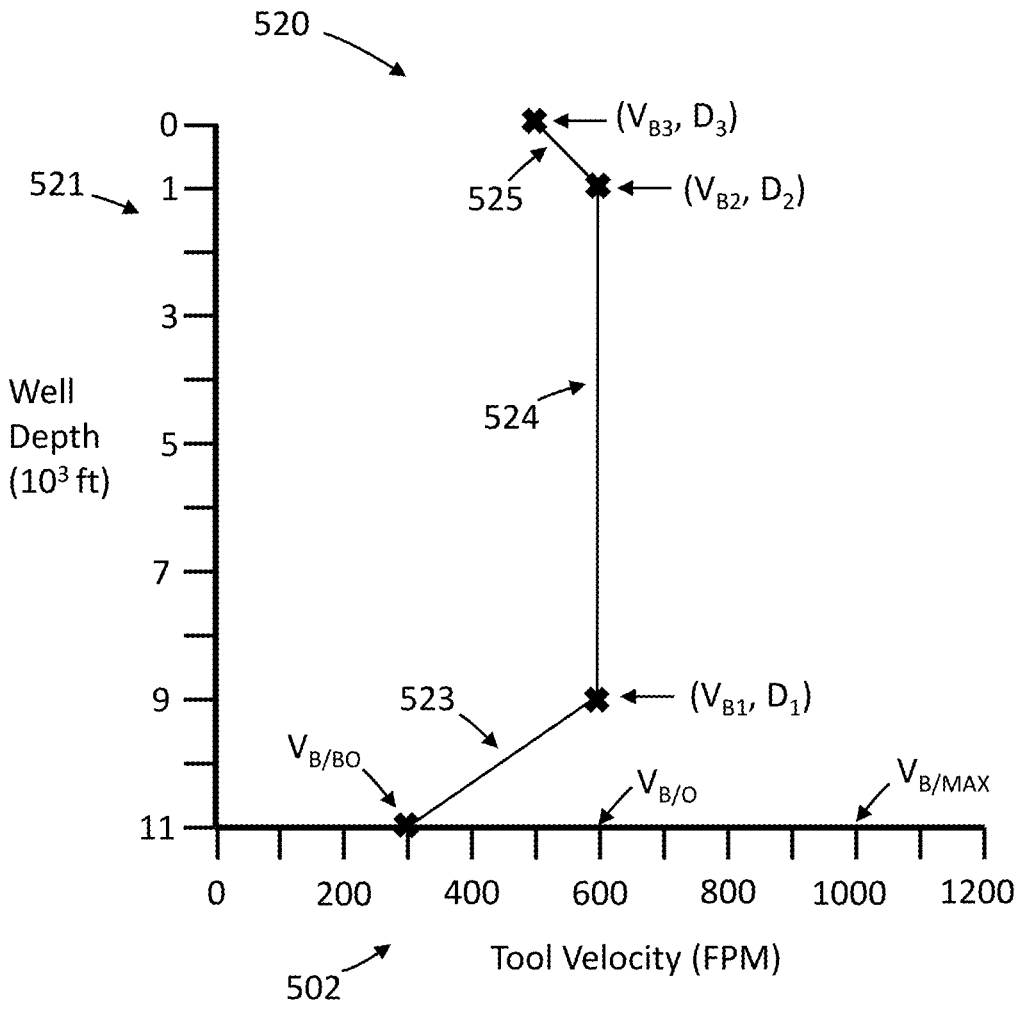
FIG. 5B depicts a first velocity profile schedule used as an input to a downhole tool movement control system of the disclosure.
Figure 5C:
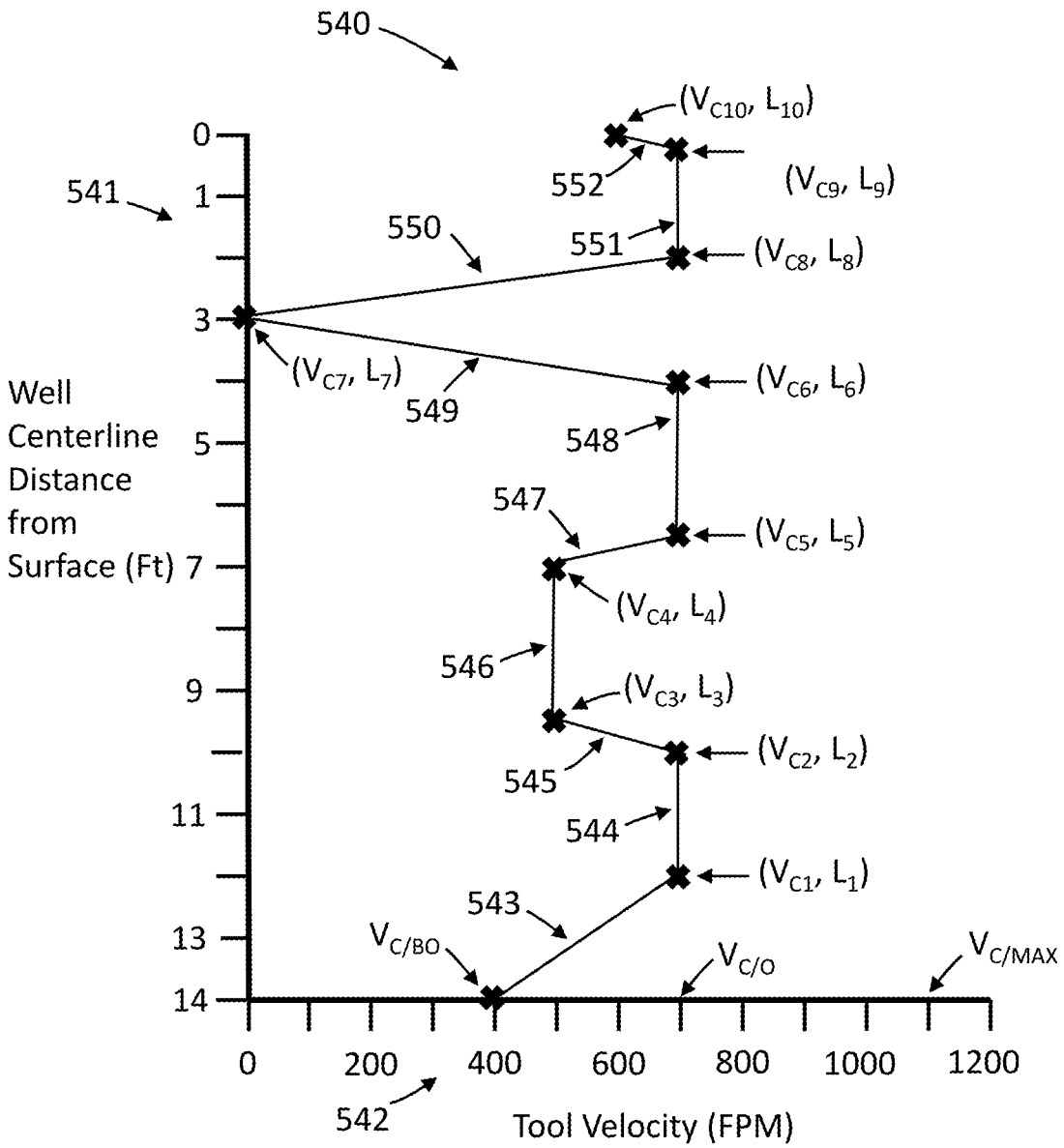
FIG. 5C depicts a second velocity profile schedule used as an input to a downhole tool movement control system of the disclosure.
Figure 5D:
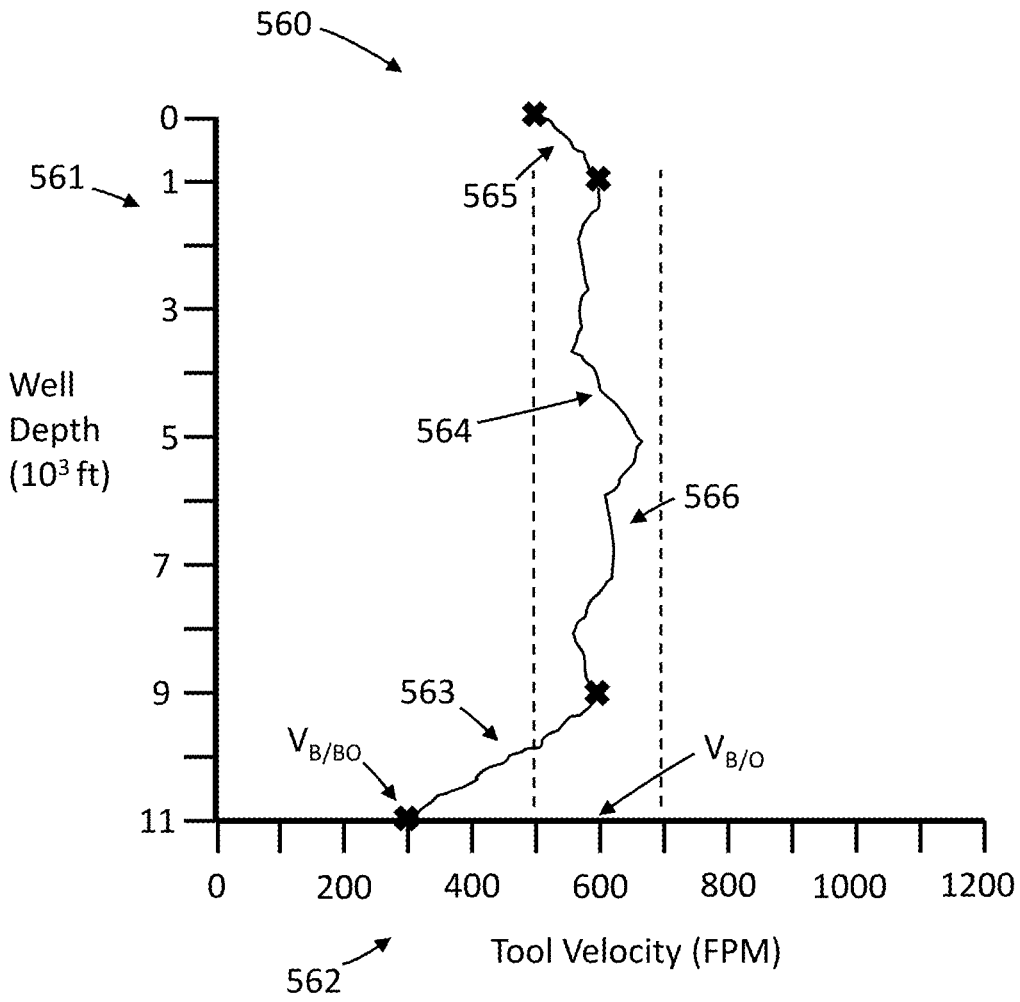
FIG. 5D depicts a representative actual velocity profile as achieved by a downhole tool movement control system of the disclosure operating to the first velocity profile schedule of FIG. 5B.

FIGS. 5B-D describe operations of the downhole tool movement control system of the disclosure against a selectable downhole tool velocity profile schedule. As briefly mentioned above, a user may provide a downhole tool velocity schedule (a desired set of downhole tool velocities with respect to location of the downhole tool in a tubing string). The downhole tubing string may be described or referenced as well depth in a vertical well, or by well measured depth (MD) in a horizontal or vertical/horizontal well (common in unconventional wells, e.g.).

FIG. 5A depicts a representative conventional velocity profile of a downhole tool of the prior art, the tool operating in a rise or ascent from a well bottom location to a surface location. As described above, conventional operations at best minimally control a downhole tool (such as a plunger) during the plunger's movement within a tubing string. The result is a plunger that commonly exceeds maximum plunger velocity, frequently reaching an unsafe velocity well above the plunger maximum velocity when reaching the surface after a rise cycle. Such is described in FIG. 5A.

FIG. 5A describes a conventional plunger rise operation 500 of the prior art. Plunger (aka tool or downhole tool) velocity is presented on the x-axis 502 in feet per minute (fpm) for a given y-axis 501 well depth in thousands of feet (ft). The tool begins a rise cycle at the bottom of the well depth (here, at 11,000 ft), and begins to move once a plunger break out velocity $V_{A/BO}$ is reached (here, 350 fpm). The plunger has an optimal velocity (a speed at which, for a given set of well conditions, an optimal effectiveness of plunger lift is obtained) of $V_{A/O}$ (here, 600 fpm). The plunger then rises, through portion rise 503, up the tubing string to reach ($V_{A1}$, $D_1$)=(400, 7000), then continues through rise 504 to reach ($V_{A2}$, $D_2$)=(600, 3000), and finally executes rise 505 to reach the surface of ($V_{A3}$, $D_3$)=1200, 0). Note that the final speed of 1200 fpm, and throughout much of the rise 505, the plunger is operating above its desired maximum speed $V_{A/MAX}$ of 1000 fpm.

The downhole tool movement control system, such as described above, may operate to a selectable downhole tool velocity schedule. Stated another way, the downhole tool movement control system may control a plunger or other downhole tool to a specified velocity at a given tubing location. Such a schedule may be established for a rise portion, a descend aka fall portion, or both a rise/fall and fall/rise cycle. FIGS. 5B and 5C describe representative selectable velocity schedules for plunger operations controlled by the downhole tool movement control system. Other schedules are possible, to include non-linear schedules. Velocity schedules may be combined and may vary with each cycle.

FIG. 5B depicts a first velocity profile (rise) schedule 520 used as an input to a downhole tool movement control system of the disclosure. Plunger (aka tool or downhole tool) velocity is presented on the x-axis 522 in feet per minute (fpm) for a given y-axis 521 well depth in thousands of feet (ft). The rise schedule 520 comprises three portions: a first portion 523, a second portion 524, and a third portion 525, as the plunger travels from the deepest well depth position (here, 11,000 ft well depth) to the surface (here, at 0 ft well depth). The plunger has a break-out velocity of $V_{B/BO}$ of 350 fpm, and optimal velocity $V_{B/O}$ of 600 fpm, and a maximum desired velocity of $V_{B/MAX}$ of 1,000 fpm. The velocity profile schedule 520 depicts a schedule for a vertical well.

The velocity profile 520 has the plunger rising from (300, 11,000) along first portion 523 to position ($V_{B1}$, $D_1$)=(600, 9,000). Note that $V_{B1}$ of 600 fpm is the plunger optimal velocity. The plunger velocity profile then enters the second portion 524 in which the plunger maintains a steady 600 fps from ($V_{B1}$, $D_1$)=(600, 9,000) to ($V_{B2}$, $D_2$)=(600, 1,000). Lastly, as the plunger continues its rise, the plunger enters the third portion 525 from ($V_{B2}$, $D_2$)=(600, 1,000) to ($V_{B3}$, $D_3$)=(550, 0). Note that the plunger thus arrives at the well head or well surface at a velocity of 550 fpm. Such reduction in velocity in the upper portion is commonly seen when liquids above the plunger pass through the wellhead. Among other things, the plunger, if operating at the first velocity profile (rise) schedule 520, operates for a majority of its rise cycle at the plunger's optimal (steady state) velocity (here, of 600 fpm).

Note that plunger steady state velocity may be defined in any of several ways. Most generally, the plunger steady state is the plunger velocity after the plunger has departed from a well bottom (that is, has moved out from a break-out speed) and moved a specified distance from the well bottom position. With reference to FIG. 5A, a steady state speed is ill-defined if not impossible to define, as the plunger continuously increases in speed during its rise cycle without control of the driving fluid flow due to expansion of the gas phase as pressure decreases as it rises in the well. In one embodiment, the steady state speed is the plunger speed when the plunger is moving over some defined interval but excluding start/stop conditions, e.g., the speed after the plunger breaks out from a resting well bottom position and accelerates to a given speed.

FIG. 5C depicts a second velocity profile schedule 540 used as an input to a downhole tool movement control system of the disclosure. The velocity profile schedule 540 depicts a schedule for a well with tubing sections other than vertical, such as a well with a horizontal portion. Plunger (aka tool or downhole tool) velocity is presented on the x-axis 542 in feet per minute (fpm) for a given y-axis 541 well measured depth from surface in thousands of feet (ft).

The rise schedule 540 comprises ten portions of consecutive integer numbers 543-552. Generally, rise schedule 540 operates for three portions (544, 548, and 551) at a velocity of 700 fpm, the plunger's optimal velocity $V_{C/O}$ and a portion 546 at a velocity of 500 fpm. Remaining portions 543, 545, 547, 549, 550, and 552 are transitional portions between two endpoint velocity values. Note that at position ($V_{C7}$, $L_7$)=(0, 3,000) the plunger comes to a stop of 0 fpm. The plunger of FIG. 5C has a maximum desired velocity of $V_{C/MAX}$ of 1,100 fpm. Note that the plunger arrives at the well head or well surface at a velocity of 600 fpm.

FIG. 5D depicts a representative actual velocity profile 560 as achieved by a downhole tool movement control system of the disclosure operating to the first velocity profile schedule 500 of FIG. 5B. Like FIG. 5B, plunger (aka tool or downhole tool) velocity is presented on the x-axis 562 in feet per minute (fpm) for a given y-axis 561 well depth in thousands of feet (ft). The tool begins a rise cycle at the bottom of the well depth (here, at 11,000 ft), and begins to move once a plunger break out velocity $V_{A/BO}$ is reached (here, 350 fpm). The plunger has an optimal velocity (a speed at which, for a given set of well conditions, an optimal effectiveness of plunger lift is obtained) of $V_{A/O}$ (here, 600 fpm). The plunger then rises, first through portion rise 563, then continues through rise 564, and finally executes rise 565 to reach the surface. During rise 564 portion the actual tool velocity maintains a velocity within a selectable velocity band 566. A velocity band is appropriate to accommodate plunger velocity variations from the optimal velocity due to possible changes in gas and liquid inflows from the reservoir, allowance for response time of measurement systems and allowances for response times and characteristics of control devices.

A series of three example operating scenarios is presented below. These scenarios in no way limit the uses or embodiments of the well production system and/or the methods of use of the well production system.

Operating Scenario One

The downhole tool movement control system may be configured with a primary objective to control the rise velocity of the downhole tool, such as primarily a plunger used to pump fluids from a wellbore. In its most basic use, the plunger is allowed to fall from surface, whether in static, non-flowing, shut-in conditions or against some flow that the tool is designed to overcome (e.g., bypass plungers). Once the tool has reached the lowest point in the well from which the pumping action is to take place, one or more valves at the surface are opened to provide sufficient upward flow of gas and liquid, such that the mixture drives the plunger upwards toward the surface. The flow rates and pressures of the mixture are impacted by the expansion of gas volume as the plunger travels from the higher-pressure lower portions of the well to the lower-pressure upper portions. The downhole tool movement control system regulates the flow through the one or more surface valves to maintain a desired speed/velocity of the rising plunger, either to a predetermined setpoint or within a specified setpoint range, compensating for changes in the forces which drive the plunger over the distance of its intended travel and with particular attention to control of the actual plunger velocity $v_p$. The result is a consistency in plunger travel speed over the rise portion of the cycle, improving pumping efficiency, reducing tool wear and improving safety conditions at surface.

Operating Scenario Two

The downhole tool movement control system may operate to switch from plunger fall to plunger rise at any point in the cycle. In certain cases, an operator may want to send the plunger only to a certain selectable depth, the selectable depth not necessarily the bottom or to a physical stop or spring assembly, and then reverse direction and bring the plunger back to surface. Such a capability would allow one to pump or "swab" (a common term for removing fluid from higher in the tubing string) based on the system parameters. The system parameters can determine, via the controller, the point at which the plunger will run in wells that have difficulty running plungers due to high liquid content. In such cases, the gas velocity deep in the well is not sufficient to drive the plunger, but higher up in the well the gas expansion and breakout changes the gas to liquid ratio (gas as actual volume, not standard volume) sufficient to provide favorable conditions. In typical current practice, an operator may guess or calculate the point this occurs in a well under flowing conditions and choose to set a fixed stop (spring assembly) at that point and run the plunger from there. One advantage of the disclosed downhole tool movement control system in operations to a selectable depth is the ability to select (and achieve) operating turns of the plunger cycle by cycle (cycle meaning and up and down or down and up) and therefore always running the downhole tool (e.g., plunger) from the most ideal location. Stated another way, the disclosed downhole movement control system may be configured to allow a user to selectably identify or select a downhole tool tubing string stop point, such a point fixed or changing with time, production line condition, or other operating condition or system parameter condition or state.

Consider an example well with 8000 ft of tubing with high liquid production. Normally, one would wish to run a plunger from the lowermost point in the well. Attempts to do this may fail to provide the most efficient pumping due to a high liquid content relative to the available gas contributing to a lack of actual gas velocity at the bottom of the tubing. Analysis is performed (or guesswork and "experience" are applied) and a decision is made to set a spring assembly with a stop at 6000 ft depth. The plunger now runs effectively. Three months later, the well is underperforming, and new analysis (or guesswork or experience) indicates the plunger would run from a lower point in the well. Wireline intervention and temporary shut-in of the well are required to move the bottom spring to the new location at 7000 ft. The plunger performs adequately. Three months later, the same process as above suggests another setpoint for the bottom spring. All of these interventions require shutting the well in, deploying surface equipment such as wireline and physical re-setting of the downhole spring.

In contrast, using the downhole tool movement control system of the disclosure, all the same applies as above, except one sets a bottom spring assembly at the end of tubing at 8000 ft. The system controller of the disclosed downhole tool movement control system calculates the ideal point from where the plunger will run effectively. The well closes and the plunger falls to this depth, at which point the controller signals the tubing line pressure valve to open and rise velocity control is applied. The controller calculates this point based on the tubing parameters for every cycle, so the point from which one pumps could change on every cycle too. For example, the turn point could be 7000 ft on the first cycle then 6800 ft on the next and 7125 ft on the next, etc. As long as one is consistent with the turnaround point determination method and consistent with the desired rise velocity, one should be pumping with the plunger with optimized conditions for every cycle. Over time, if the well supports pumping from greater depths, then the controller will automatically track that downwards (or vice versa if this is the case). One could think of this as "auto-swabbing" as a feature of products to accomplish this.

Operating Scenario Three

The use of a supplemental gas volume supplied to the annulus of a well has been described above. The downhole tool movement control system of the disclosure enables a method to control injection gas for wells that require supplementary gas volume supplied from surface down the casing-tubing annulus. For example, assume a well similar to that of Scenario Two above, wherein over time the auto-swabbing has permitted the well to be pumped all the way to bottom. This has been accomplished while providing a fixed rate of gas injection from the surface. But here, we have progressed forward by some amount of time and the volume of gas injected is greater than what is actually required, resulting in higher than necessary gas injection costs (we have to use a motor-driven compressor at surface to supply this injection gas, which is an expense). The controller of the downhole tool movement control system may calculate the actual required volume of gas required at the end of tubing and provide a signal to the injection gas controller (e.g., a variable speed drive or motorized control valve, and/or the supplemental gas volume valve 234 or a supplemental gas volume EFM 235) to regulate the injection gas rate, providing "just the right amount" of gas injection to make the system operate effectively. This makes the entire system responsive to efficient pumping and efficient use of external energy sources.

FIG. 6 provides a data table of calculations for various plunger operations. Generally, calculations are made under various line pressures (e.g., 1000, 150, etc.), various $P_{BH}$ (e.g., 1500, 750, etc.), to determine plunger speed at surface (i.e., at well head) and average plunger velocities. Each assume a plunger break-out speed (the speed required for a plunger to depart from a resting position at bottom of the hole) of 300 ft/min. It can be seen that in many situations, a plunger exceeds a typical operating speed range of 600-900 ft/min). If a plunger contacts a wellhead at dangerously high speeds, undesirable results may include: plunger damage, surface lubricator damage, wellhead damage and, on occasion, breach of the wellhead with attendant safety risks and potential uncontrolled discharge of well contents into the environment.

Other embodiments and/or applications of the downhole tool movement control system and/or method of use are possible. For example, the system and/or method could be used to control fluid velocity, even without a downhole tool in the well.

What is claimed is:

1. A downhole tool movement control system comprising:

a system controller comprising a system processor, the system controller operating to control a downhole tool velocity of a downhole tool within a selectable steady state velocity range, the downhole tool operating within a tubing string disposed within a well casing and having a first tubing string portion and a second tubing string portion and configured to receive the downhole tool, the tubing string in fluid communication with a hydrocarbon deposit and having a set of well parameters comprising a first set of well parameters, the downhole tool having a set of downhole tool parameters; and a system control valve in fluid communication with the tubing string and having a set of system control valve settings comprising an initial system control valve setting, the system control valve controlled by the system controller;

wherein:

based on the first set of well parameters, the set of downhole tool parameters, and the initial system control valve setting, the system processor calculates: a) the downhole tool velocity at a set of downhole tool locations, and b) a corresponding first set of controller system control valve settings at each of the downhole tool locations that will operate the downhole tool within the selectable steady state velocity range;

the system controller operates the system control valve at the set of controller system control valve settings corresponding to the set of downhole tool locations as the downhole tool travels to each of the set of downhole tool locations;

the velocity of the downhole tool at each of the set of downhole tool locations is within the selectable steady state velocity range; and the system control valve settings comprise a system control valve flow rate setting.

2. The system of claim 1, wherein the tubing string comprises a set of tubing string sections to form a tubing string of tubing string total length, each of the tubing string sections comprising at least one of the set of downhole tool locations.

3. The system of claim 1, wherein:

the downhole tool travels a cycle, the cycle defined as travel from the first tubing string portion to the second tubing string portion and back to the first tubing string portion, the cycle having a first measured cycle time, the first measured cycle time measured by a sensor positioned at the wellhead portion;

the processor calculates a first predicted cycle time of the cycle and calculates a first cycle time differential defined as the difference between the first measured cycle time and the first predicted cycle time; and the processor calculates a second set of controller system control value settings associated with the first cycle time differential.

4. The system of claim 3, wherein the first tubing string portion is coupled to a wellhead portion of tubing string and the second tubing string portion is coupled to a bottom hole assembly.

5. The system of claim 1, wherein the set of downhole tool parameters include a downhole tool notional rise velocity profile and a downhole tool notional fall velocity profile, and the downhole tool is a plunger.

6. The system of claim 1, wherein the system processor calculates the downhole tool velocity at the set of downhole tool locations at least every 60 seconds.

7. The system of claim 1, wherein:

the downhole tool has a selectable maximum velocity; and the downhole tool velocity never exceeds the selectable maximum velocity.

8. The system of claim 7, wherein the downhole tool has a selectable average steady state velocity and an average of the downhole tool steady state velocity is within 20% of the selectable average steady state velocity.

9. A downhole tool movement control system comprising:

a system controller comprising a system processor, the system controller operating to control a downhole tool velocity of a downhole tool at a selectable velocity schedule, the downhole tool operating within a tubing string disposed within a well casing and having a first tubing string portion and a second tubing string portion and configured to receive the downhole tool, the tubing string in fluid communication with a hydrocarbon deposit and having a set of well parameters comprising a first set of well parameters, the downhole tool having a set of downhole tool parameters, the selectable velocity schedule defining a set of downhole tool velocities at a set of tubing string locations; and a system control valve in fluid communication with the tubing string and having a set of system control valve settings comprising an initial system control valve setting, the system control valve controlled by the system controller, the set of system control valve settings determining a set of control valve flow rates;

wherein:

based on the first set of well parameters, the set of downhole tool parameters, and the initial system control valve setting, the system processor calculates: a) a set of downhole tool velocities at the set of tubing locations, and b) a corresponding first set of controller system control valve settings at each of the tubing string locations that will operate the downhole tool at the selectable velocity schedule;

the system controller operates the system control valve at the set of controller system control valve settings corresponding to the set of tubing string locations as the downhole tool travels to each of the set of tubing string locations; and the set of velocities of the downhole tool at each of the set of tubing string locations is within a selectable velocity range.

10. The system of claim 9, wherein:

the first tubing string portion is coupled to a wellhead portion of tubing string and the second tubing string portion is coupled to a bottom hole assembly;

the set of wellhead parameters comprise a tubing inner diameter, a tubing pressure, a line pressure, a gas rate, a liquid/gas ratio, and a depth to the bottom hole assembly; and the set of downhole tool properties comprise downhole tool type, downhole tool notional fall velocity profile, and downhole tool notional rise velocity profile.

11. The system of claim 10, wherein the system processor further calculates a set of gas velocities within the tubing string at each of the set of tubing string locations, the calculation of the set of downhole tool velocities associated with the set of gas velocities.

12. A method of controlling velocity of a downhole tool within a tubing string of a well casing, the method comprising:

positioning a downhole tool within a tubing string, the tubing string disposed within a well casing and having at least a first tubing string portion and a second tubing string portion, the downhole tool configured to travel within the tubing string between a first tubing string portion and a second tubing string portion, the travel at a selectable velocity range, the tubing string in fluid communication with a hydrocarbon deposit and having a set of well parameters comprising a first set of well parameters;

providing a system control valve in fluid communication with the tubing string and having a set of system control valve settings comprising an initial system control valve setting, the set of system control valve settings associated with a set of system control valve flow rate settings;

providing a system controller comprising a computer processor, the computer processor having machine-executable instructions operating to:

receive the first set of well parameters;

receive the initial system control valve setting;

receive a set of downhole tool parameters comprising a downhole tool type;

calculate the downhole tool velocity at a set of downhole tool locations within the tubing string based on the first set of well parameters, the set of downhole tool parameters, and the initial system control valve setting;

calculate a first set of controller system control valve settings corresponding to each of the set of downhole tool locations, the first set of controller system control valve settings calculated so that the downhole tool operates within the selectable steady state velocity range at each of the set of downhole tool locations;

communicate the set of controller system valve settings to the system control valve; and operate the system control valve to the first set of controller system valve settings corresponding to the set of downhole tool locations as the downhole tool travels to each of the set of downhole tool locations; wherein:

the velocity of the downhole tool at each of the set of downhole tool locations is within the selectable steady state velocity range.

13. The method of claim 12, wherein the tubing string comprises a set of tubing string sections of uniform length to form a tubing string of tubing string total length, each of the tubing string sections comprising at least one of the set of downhole tool locations.

14. The method of claim 13, wherein the first tubing string portion is coupled to a wellhead portion of tubing string and the second tubing string portion is coupled to a bottom hole assembly.

15. The method of claim 14, wherein:

the downhole tool travels a cycle, the cycle defined as travel from the first tubing string portion to the second tubing string portion and back to the first tubing string portion, the cycle having a first measured cycle time, the first measured cycle time measured by a sensor positioned at the wellhead portion;

the processor calculates a first predicted cycle time of the cycle and calculates a first cycle time differential defined as the difference between the first measured cycle time and the first predicted cycle time; and the processor calculates a second set of controller system control value settings associated with the first cycle time differential.

16. The method of claim 12, wherein the set of downhole tool parameters include a downhole tool notional rise velocity profile and a downhole tool notional fall velocity profile, and the downhole tool is a plunger.

17. The method of claim 13, wherein the set of well parameters include at least one of pressure in the first tubing portion, pressure in the second tubing portion, and bottom hole pressure.

18. The method of claim 12, further comprising the step of selecting a downhole tool tubing string stop point located between the first tubing string portion and the second tubing string portion, the system controller operating to stop the travel of the downhole tool substantially near the downhole tool stop point.

19. The method of claim 12, wherein:

the set of well parameters comprise a set of measured well parameters to include gas rate and at least one of tubing pressure and line pressure; and the measured well parameters are output by a flow measurement unit in fluid communication with the tubing string.

20. The method of claim 19, wherein the set of well parameters comprise a set of calculated well parameters to include a set of gas velocities at each of the set of downhole tool locations.

* * * * *